US008480096B2

(12) United States Patent
Chang

(10) Patent No.: US 8,480,096 B2
(45) Date of Patent: Jul. 9, 2013

(54) STRUCTURE OF INLINE SKATES

(76) Inventor: Yen-Nien Chang, Taipei County (TW)

( * ) Notice: Subject to any disclaimer, the term of this patent is extended or adjusted under 35 U.S.C. 154(b) by 321 days.

(21) Appl. No.: 12/844,078

(22) Filed: Jul. 27, 2010

(65) Prior Publication Data

US 2010/0320707 A1 Dec. 23, 2010

Related U.S. Application Data

(63) Continuation-in-part of application No. 11/761,010, filed on Jun. 11, 2007, now abandoned.

(30) Foreign Application Priority Data

Aug. 3, 2006 (TW) ..... 95128548 A

(51) Int. Cl.
*A63C 17/14* (2006.01)
*A63C 17/26* (2006.01)

(52) U.S. Cl.
USPC ..... 280/11.201; 280/11.225

(58) Field of Classification Search
USPC ..... 280/11.201, 11.204, 11.207, 11.209, 280/11.211, 11.215, 11.217, 11.225, 11.28
See application file for complete search history.

(56) References Cited

U.S. PATENT DOCUMENTS

| | | | | | |
|---|---|---|---|---|---|
| 296,833 | A * | 4/1884 | Hanlon | 280/11.201 |
| 1,016,447 | A * | 2/1912 | Sheahan | 280/11.201 |
| 1,154,300 | A * | 9/1915 | Finkelstein | 280/11.28 |
| 1,517,352 | A * | 12/1924 | Foote | 280/11.201 |
| 3,790,187 | A * | 2/1974 | Radu et al. | 280/11.201 |
| 5,135,244 | A * | 8/1992 | Allison | 280/11.28 |
| 5,342,071 | A * | 8/1994 | Soo | 280/11.207 |
| 5,486,011 | A * | 1/1996 | Nelson | 280/11.207 |
| 5,620,190 | A * | 4/1997 | Maggiore | 280/11.201 |
| 5,954,348 | A * | 9/1999 | Santarsiero et al. | 280/11.201 |
| 6,012,727 | A * | 1/2000 | Chang | 280/11.28 |
| 6,874,794 | B2 * | 4/2005 | Holland | 280/11.206 |

* cited by examiner

*Primary Examiner* — Frank Vanaman
(74) *Attorney, Agent, or Firm* — Rosenberg, Klein & Lee

(57) ABSTRACT

A structure of inline skates is provided, the structure of inline skates includes a cushion device, a wheel with an annular ratchet wheel on its side, and a pawl assembly. By using the user's weight to press down the structure of present invention, the wheel with the annular ratchet wheel on its side engages the pawl assembly, which stops the wheel with the annular ratchet wheel on its side from rolling in one direction, and the wheel with the annular ratchet wheel on its side can roll in another direction. Thereby, the structure of inline skates is more ergonomic and exercise injuries can be prevented. In addition, a brake is provided for providing shock absorption and as a fulcrum to make more powerful acceleration. Besides, automatic support upright is also provided for avoiding tumbles.

10 Claims, 19 Drawing Sheets

STRUCTURE OF INLINE SKATES

REFERENCE TO RELATED APPLICATIONS

This Patent Application is being filed as a Continuation-in-Part application of Ser. No. 11/761,010, filed 11 Jun. 2007, currently pending.

FIELD OF THE INVENTION

The present invention relates generally to inline skates, and particularly to inline skates that combining a one-way roll stop device and a cushion device for providing the inline skates with superior braking effect during sliding as well as with more forceful acceleration holds. Thereby, a structure of inline skates with ergonomics, exercise-injury prevention, and comfort is provided.

BACKGROUND OF THE INVENTION

Inline skating is a rising roller-skating exercise. To date a variety of types has developed including mainly recreational, figure, cross-country, acrobatic, and speed. Special structures are designed for cross-country and speed inline skates to meet their speed demands or requirements by special environments. In addition, user needs to receive extraordinary and long-term trainings to handle or use them appropriately. The basic structure and function thereof similar to recreational inline skates, details of the inline skates of these types are not described here. In the following, recreational, figure, and acrobatic inline skates are described in detail.

First, for a recreational inline skate, the structure thereof includes a boot, a base under the boot, and a plurality of wheels adapted on the base. There is no front brake pad. When the left leg slides, it is necessary to use the right leg for pressing the ground and pushing backwards in the direction slightly deviating from the direction of sliding, and then a forward force for the left leg is given. Owing to the larger wheel diameter with the longer span, it is laborious for both legs to alternatingly press down and push angularly to maintain a sliding motion over a long time period. In addition, it violates ergonomics as well. Besides, recreational inline skates do not provide effective braking arrangement. Some brands add rear brake pads behind the roller skates. While braking, the player has to put forth his strength to raise his feet upwards with his ankles pushed downwards so that the rear brake pads under the ankles can produce friction with the ground. By doing this, slight braking effect is attained. However, the braking effect is very poor, and the braking action violates ergonomics as well. Furthermore, the rear brake pads tend to make both legs stuck with and bump against each other and consequently make the player stumble when he alternates his legs to slide or when he corners (forward or backward crossovers). Thereby, most players disassemble the rear brake pads by themselves, which makes the rear brake pads exist in name only.

Moreover, for a figure inline skate, a front brake pad is adapted at the first-wheel position of a recreational inline skate, and all wheels are shrunk and arranged behind the front brake pad. Hence, the figure inline skate slides slower and unstable. When sliding forward, the center of gravity leans forward. Slight incaution results in touch of the front brake pad on the sliding leg on the ground, which is very dangerous because it will cause the player trip forward.

As for an acrobatic line skate, no brake is adapted thereon because a brake device that is like the one on a recreational or a figure inline skate obstructs absolutely acrobatic movements and thereby results in danger. However, it does not mean that an acrobatic inline skate need not a brake device. In fact, tumbles when wearing acrobatic inline skates occur frequently. Some severe injuries even happened.

To sum up, various current inline skates cannot provide an effective and safe brake device. A special braking skill, that is, T-stop, refers to turning aside and opening both legs abruptly during sliding to make both legs perpendicular to the direction of sliding for attaining braking effect. However, this skill needs long-term practices. Slight incaution tends to result in tumble and accidental injuries such as scrapes, collision injuries, and sprains. Besides, the skill violates ergonomics. In addition to ease of wear on the inline skates, T-stop is not applicable in all fields. If the field is slightly slippery, unsmooth, or has too much grip, falling over tends to happen. Thereby, improved brake device of inline skates is desired for solving inconveniences in operations and problems of frequent exercise injuries.

Owing to the drawbacks and imperfections of inline skates described above, the present invention provides inline skates complying with ergonomics, being exercise-injury preventive, shock absorptive, and comfortable. In addition, the inline skates according to the present invention provide multiple brakes as well as providing more powerful acceleration. By supporting upright automatically, the inline skates according to the present provide active safety for players.

SUMMARY

An objective of the present invention is to provide a structure of inline skates, which can achieves superior braking effect in a manner complying ergonomics. In addition, the inline skates according to the present invention can support upright automatically on the go for preventing tumbles. Thereby, exercise injuries are reduced or avoided accordingly, and active safety is provided.

Another objective of the present invention is to provide a structure of inline skates, which can provide effectively more forceful acceleration holds as well as shock-absorbing capability for comfort. Thereby, the operation quality of the inline skates is improved.

In order to achieve the objectives and effects described above, the present invention provides a structure of inline skates, which includes a base, a wheel set, at least one one-way roll stop device, and at least one cushion device. The base includes at least one connection member and an orientation member. Two side plates are disposed on the both sides of the connection member. A plurality of pivotal hole are disposed on the side plates. A long pivotal bore is disposed on the front end or the rear end of the least one side plate. The wheel set includes a front wheel and a rear wheel. The front wheel and the rear wheel are pivoted on the side plates. The front wheel and the rear wheel includes at least one bearing, respectively. The one-way roll stop device includes an annular ratchet wheel and a pawl assembly. The annular ratchet wheel is disposed on the side of the front wheel or the rear wheel of the wheel set. The annular ratchet wheel has a hole to form an annular shape. The diameter of the hole is greater than the diameter of the bearing, and the hole of the annular ratchet wheel is opposite to the bearing.

The pawl assembly is disposed on the base, the annular ratchet wheel is disposed opposite to the pawl assembly. The annular ratchet wheel and the pawl assembly are spaced from one another. The orientation member is utilized to orientate the pawl assembly for making the pawl assembly space from the annular ratchet wheel when the position of the base corresponding to the front wheel or the rear wheel is not pressed.

The cushion device includes a sliding block and sleeve assembly and a spring. The sliding block and sleeve assembly includes a sleeve, which has a trough to be used for accommodating the spring. A pivotal hole is disposed at the lower end of the sleeve. The rear side of the sleeve has a sliding block corresponding to the long pivotal bore of the side plate with a shorter length. The sliding block is inset the long pivotal bore.

One end of the cushion device is disposed on the base, and the other end of the cushion device is connected with the front wheel or the rear wheel by passing a screw bolt assembly through the pivotal hole of the sliding block and sleeve assembly, the long pivotal bore of the side plate, and the front wheel or the rear wheel. The front wheel or the rear wheel can roll in two direction when the position of the base corresponding to the front wheel or the rear wheel is not pressed. When the position of the base corresponding to the front wheel or the rear wheel is pressed, the front wheel or the rear wheel of the wheel set is pressed accordingly. The cushion device eases the stress through compression thereof. When the cushion device compresses, it drives the annular ratchet wheel of the one-way roll stop device to contact with the pawl assembly to stop the front wheel or the rear wheel from rolling in one direction, and the front wheel or the rear wheel can roll in another direction. Thereby, braking effect and an acceleration hold are provided. In addition, shock-absorbing effect is provided as well by the cushion.

In order to make the structure and characteristics as well as the effectiveness of the present invention to be further understood and recognized, the detailed description of the present invention is provided as follows along with preferred embodiments and accompanying drawing figures.

DETAILED DESCRIPTION

Figure 1:
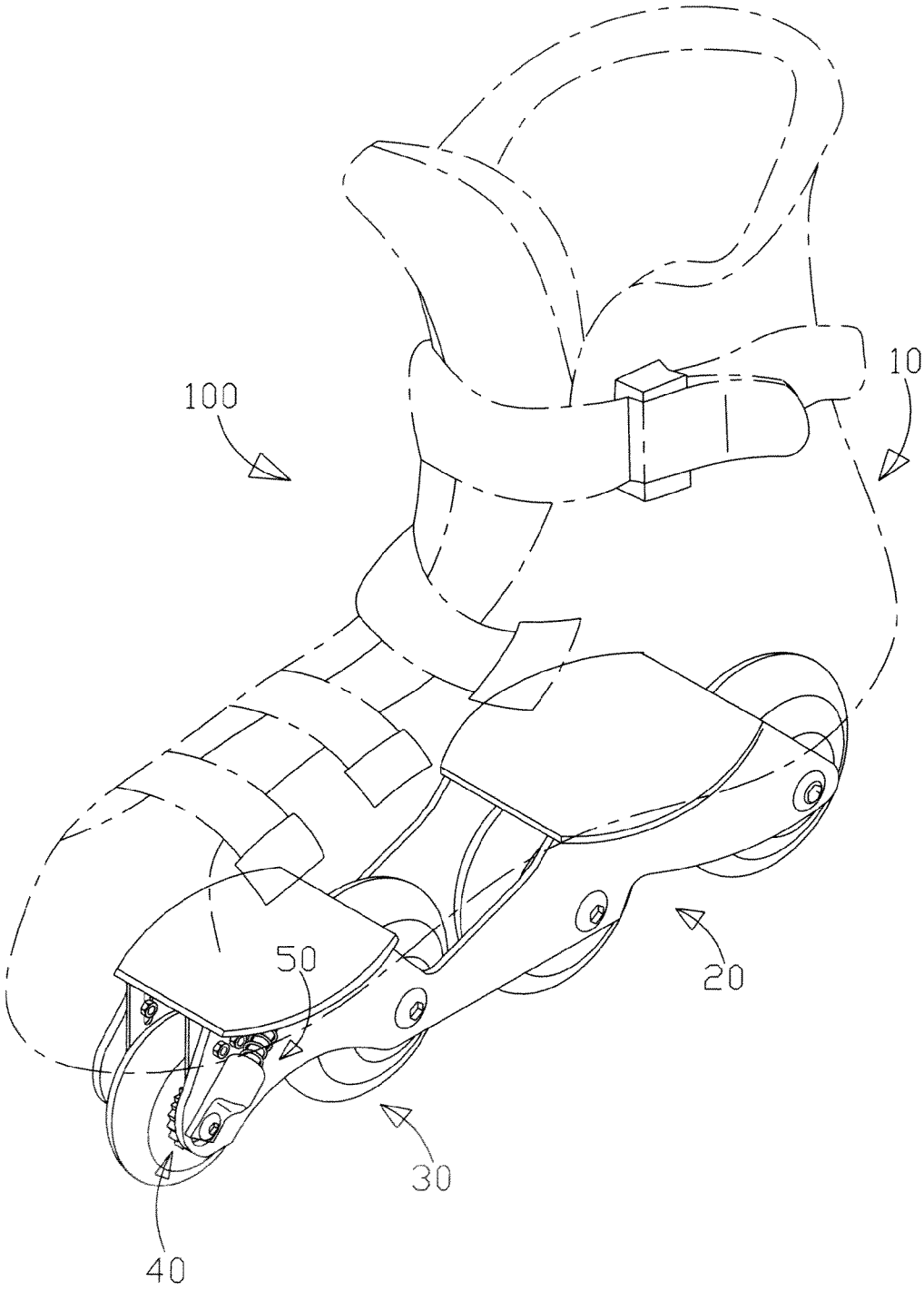
FIG. 1 shows a three-dimensional schematic diagram according to a first preferred embodiment of the present invention.
Figure 2:
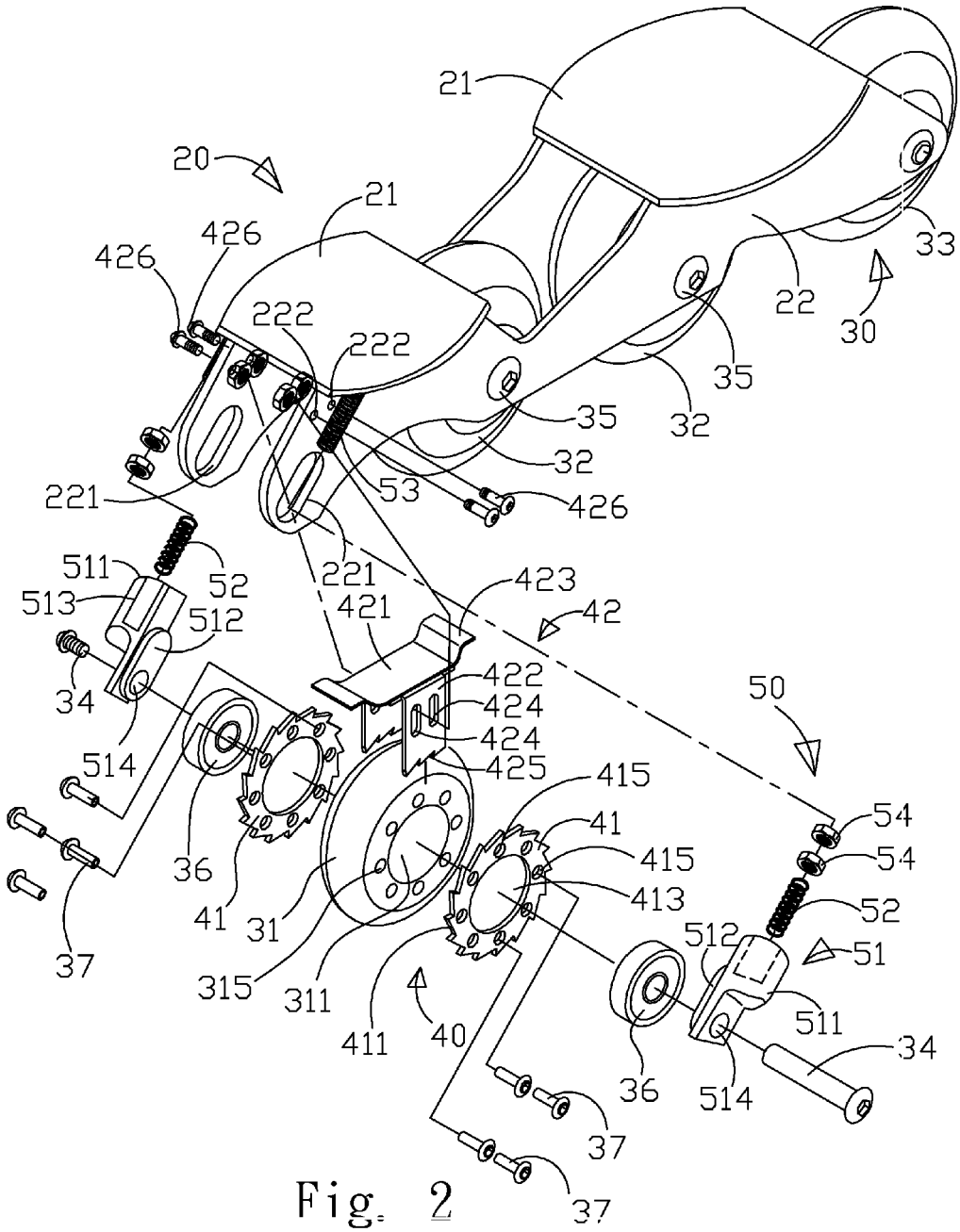
FIG. 2 shows an explosion view according to the first preferred embodiment of the present invention.
Figure 3:
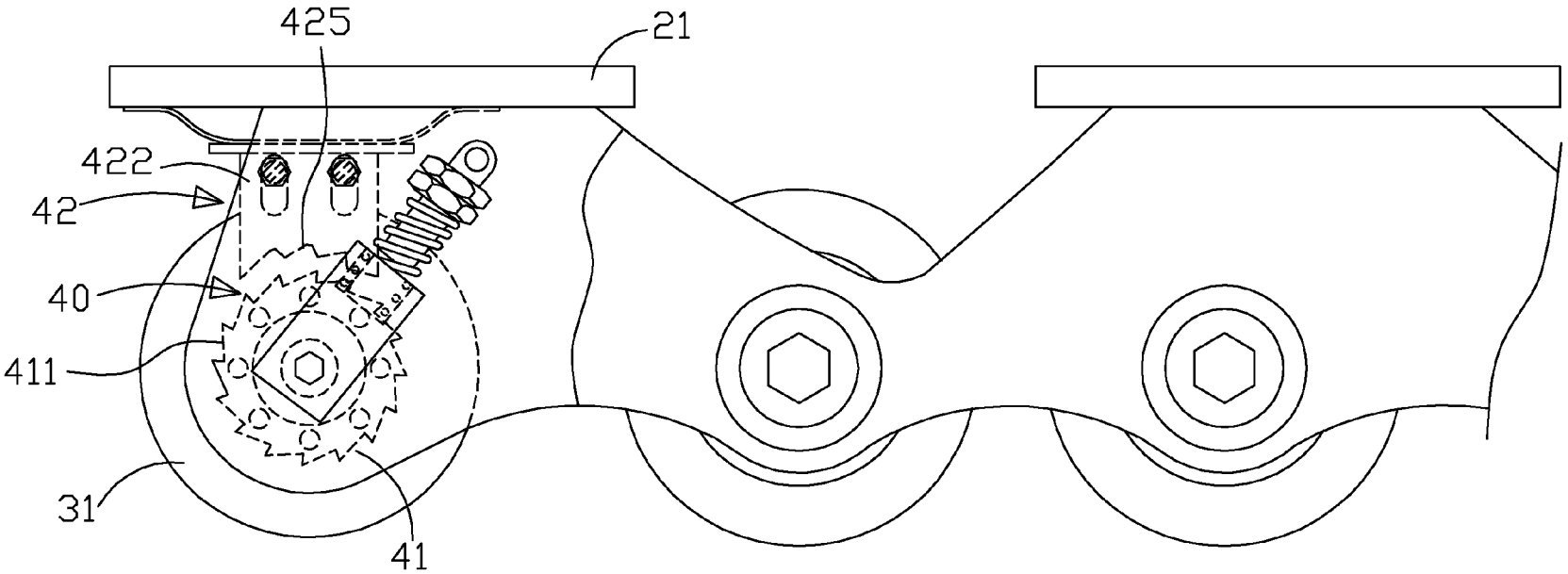
FIG. 3 shows a side view according to the first preferred embodiment of the present invention.

FIGS. 1 to 3 show a structure of inline skates according to a first preferred embodiment of the present invention. The inline skate 100 includes a boot 10, a base 20, a wheel set 30, an one-way roll stop device 40, and a cushion device 50.

The boot 10 is disposed on the base 20, and the base 20 comprises at least one connection member. The connection member is a connection plates 21 according to this embodiment. Two side plates 22 is disposed under both sides of the connection plate 21, respectively. At the front end of the side plates 22, a long pivotal bore 221 is disposed. Behind and above the long pivotal bore 221, two orientation holes 222 are disposed on the side plates 22. In addition, behind the long pivotal bore 221, three pivotal holes (not shown in the Figures) are disposed for mounting the wheel set 30. The wheel set 30 includes a front wheel 31, two intermediate wheels 32, and a rear wheel 33. The front wheel 31 includes a hole 311 and a plurality of fixed holes 315, and at least one bearing 36 is set in the hole 311. The front wheel 31 is adapted between the two long pivotal bores 221 by means of a screw bolt assembly 34. The intermediate wheels 32 and the rear wheel 33 are adapted between pivotal holes of the side plates 22 behind the long pivotal bores 221 by means of screw bolt assemblies 35, respectively. In the present invention, It can also be that the wheel set 30 includes only one intermediate wheel 32, or the wheel set 30 only includes the front wheel 31 and the rear wheel 33 without any intermediate wheel 32 disposed therein.

The one-way roll stop device 40 includes an annular ratchet wheel 41 and a pawl assembly 42. The annular ratchet wheel 41 and the pawl assembly 42 serve as a roll member and an one-way brake member respectively. The annular ratchet wheel 41 has a hole 413 and is an annular-shaped slice and is smaller slightly in diameter than the front wheel 31. It is manufactured integrally and is mounted pivotally at the center on the side of the front wheel 31. Alternatively, the annular-shaped slice can be fixedly coupled to the center on the side of the front wheel 31. As shown in FIG. 2, the annular ratchet wheel 41 has a plurality of fixed holes 415. The annular ratchet wheel 41 is fixed on the side of front wheel 31 by passing a plurality of fixing members 37 through the fixed holes 415 and 315. First ratchet teeth 411 with one-way hook-shaped teeth are disposed on the periphery of the annular ratchet wheel 41. The diameter of the hole 413 of the annular ratchet wheel 41 is greater than the diameter of the bearing 36, and the hole 413 is opposite to the bearing 36. It is not necessary to remove the annular ratchet wheel 41 when the bearing 36 is needed to change. It will be convenient to change the bearing 36. Otherwise, the weight of the annular ratchet wheel 41 is reduced while the annular ratchet wheel 41 has the hole 413.

The pawl assembly 42 includes an elastic plate 421 and pawls 422 disposed on both sides under the elastic plate 421.

The elastic plate 421 is roughly a U-shaped plate. The shape here according to a preferred embodiment is used for description but not for limiting its scope. On both ends of the elastic plate 421, two wing plates 423, which extend upwards and outwards, are adapted. At least one second ratchet teeth 425 is disposed on the pawl 422, which has two long bores 424. The pawl assembly 42 is orientated on the orientation holes 222 by passing at least one orientation member 426 through the long bores 424 and the orientation holes 222, the ratchet wheel 41 and the pawl assembly 42 are spaced from one another (shown in FIG. 3), and the orientation member 426 here according to one embodiment is a screw bolt assembly.

The wing plates 423 of the elastic plate 421 connect against the underside of the connection plate 21 while making the second ratchet teeth 425 of the pawls 422 correspond to the first ratchet teeth 411 of the annular ratchet wheel 41. Thereby, the pawl assembly 42 can move up and down due to the orientation member 426 can move up and down in the long bores 424. Moreover, because the elastic plate 421 has elasticity and can extend and compress, the pawl assembly 42 can have elastic cushion effect accordingly, which occurs when the ratchet wheel 41 is not locked but can slide freely. Furthermore, the pawl assembly 42 has the two pawls 422 without requiring the elastic plate 421 and the wing plates 423 disposed thereon. The pawls 422 are disposed on the side plates 22 of the base 20 by passing the orientation member 426 through the long bores 424 of the pawls 422 and the orientation holes 222.

The cushion devices 50 are disposed on one side of the side plates 22, respectively, including two sliding block and sleeve assemblies 51, two springs 52, two adjustment shafts 53, and at least one nut 54. The sliding block and sleeve assembly 51 is an assembly with a sleeve 511 and a sliding block 512, and the sliding block 512 is disposed on the rear side of the sleeve 511. The sliding block 512 is a long block corresponding to the long pivotal bore 221 with a shorter length. A pivotal hole 514 is adapted at the lower end of the sliding block and sleeve assembly 51. The sliding block and sleeve assembly 51 is disposed on the side of the front wheel 31 by passing the screw bolt assembly 34 through the pivotal hole 514, the long pivotal bore 221 and the front wheel 31. The sliding block 512 insets the long pivotal bore 221.

A trough 513 is disposed on the top of the sleeve 511 (as shown in FIG. 3), and is used for accommodating the spring 52. The spring 52 is put around the adjustment shaft 53, whose top end is fixedly coupled to the side plate 22 of the base 20. The top end of the adjustment shaft 53 also can be fixedly coupled to the connection plate 21 of the base 20. In addition, threads are adapted on the adjustment shaft 53 with nuts 54 thereupon for confining the spring 52 between the trough 513 and the nut 54. By adjusting the threading locations of the nuts 54, the compression force of the spring 52 can be adjusted accordingly. Hence, requirements by players with different weights or by various cushioning conditions can be met by adjustments at any time.

Please refer to FIG. 3. The first ratchet teeth 411 on the annular ratchet wheel 41 of the one-way roll stop device 40 protrude opposite to the second ratchet teeth 425 on the pawl 422 of the pawl assembly 42, and the first ratchet teeth 411 on the annular ratchet wheel 41 and the second ratchet teeth 425 on the pawl 422 are spaced from one another. Besides, when the annular ratchet wheel 41 contacts with the pawl assembly 42, according to the rolling direction of the annular ratchet wheel 41, two statuses result including an occlusion and cease-rolling status, and a free-sliding and maintain-rolling status. When the one-way roll stop device 40 is disposed on the front wheel 31, it is installed to make the annular ratchet wheel 41 and the pawl assembly 42 in the free-sliding and maintain-rolling status when the annular ratchet wheel 41 rolls forwards, and in the occlusion and cease-rolling status when the annular ratchet wheel 41 rolls backwards. Thereby, when the one-way roll stop device 40 is disposed on the front wheel 31, it can stop the front wheel 31 from rolling if the front wheel 31 rolls backwards.

Figure 4:
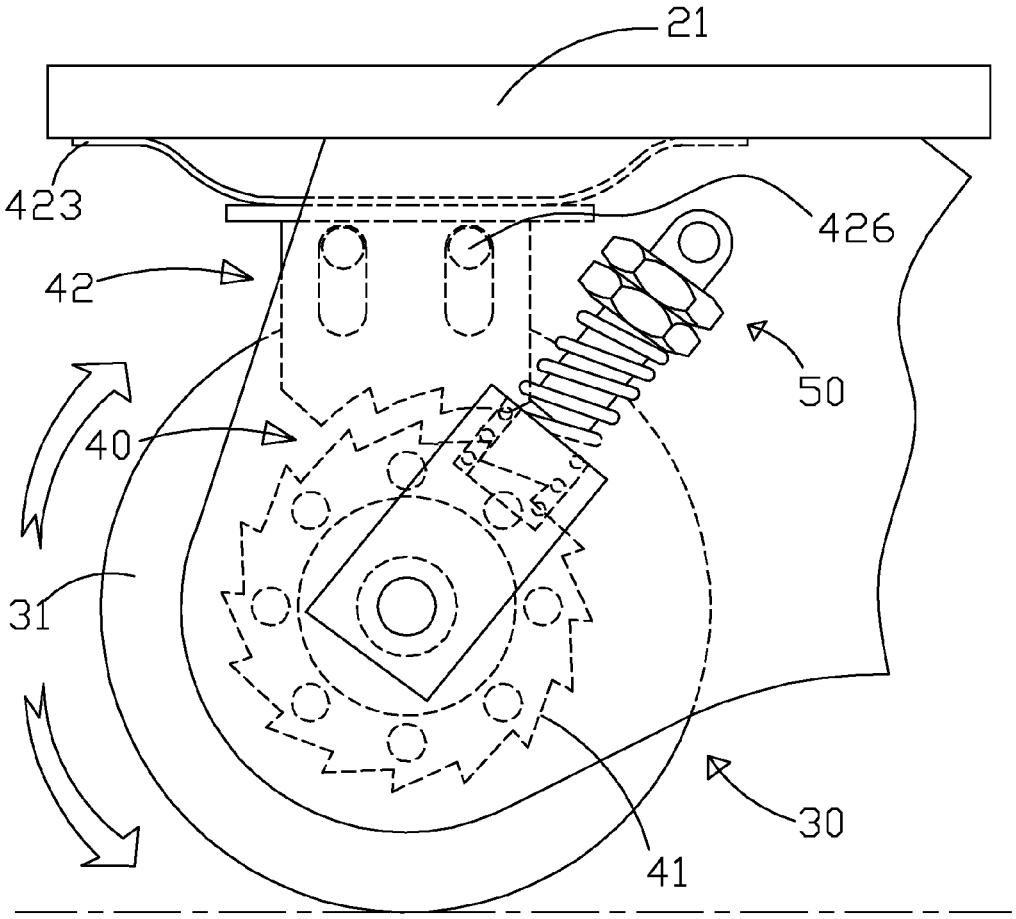
FIG. 4 shows an action schematic diagram of a front wheel according to the first preferred embodiment of the present invention.

Please refer to FIG. 4. In general, when the inline skates slide forward, the weight of the player is distributed evenly on the front wheel 31, the two intermediate wheels 32, and the rear wheel 33. In this scenario, the front wheel 31 maintains common operation condition. The pawl assembly 42 is orientated on the base 20 by the means of the orientation member 426, and therefore the annular ratchet wheel 41 and the pawl assembly 42 are spaced from one another. Thus, the annular ratchet wheel 41 and the pawl assembly 42 are not contacted each other and does not affect the roll of the front wheel 31. Therefore, the front wheel 31 can roll forwards or backwards. Even if the player pushes downwards the front wheel 31, the front wheel 31 will not stop rolling forward. This is because when the inline skates move forwards, the front wheel 31, and hence the annular ratchet wheel 41, roll forwards as well. Thereby, the annular ratchet wheel 41 and the pawl assembly 42 are not occlusive. Through the elastic cushioning function of the pawl assembly 42, the annular ratchet wheel 41 and the pawl assembly 42 will be in the free-sliding and maintain-rolling status.

Figure 5:
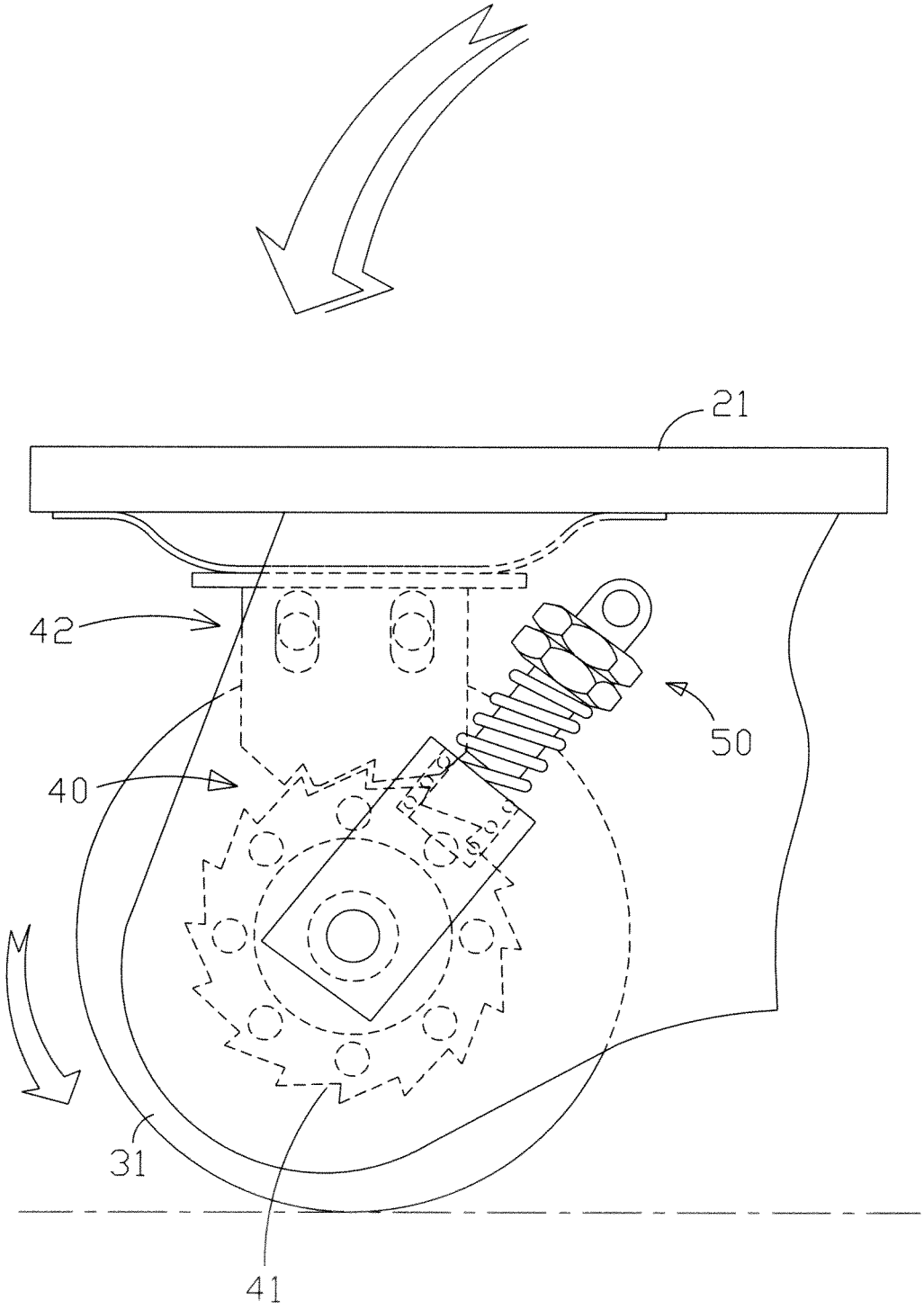
FIG. 5 shows a resistive action schematic diagram of a front wheel according to the first preferred embodiment of the present invention.

Please refer to FIG. 5. The braking function of the one-way roll stop device 40 disposed on the front wheel 31 is similar to the ratchet wheel in front of a general figure skate or to the brake pad in front of a conventional four-wheel skate, and is done by tipping toes while sliding backwards. If acceleration is desired, the back propelling leg uses the front wheel 31 to propel backwards. At the instant of propelling, the front wheel 31 rolls backwards. Thereby, when the player needs braking or acceleration, the front wheel 31 is pressed downwards. At this moment, the front wheel 31 rolls backwards. Because of downward pressure on the cushion device 50 by weight, the annular ratchet wheels 41 on sides of the front wheel 31 engage with the pawl assemblies 42 and rolling is stopped. Hence, the rolling of the front wheel 31 is stopped in one direction. Thereby, braking effect or a hold for forward acceleration is provided. Consequently, when the front wheel 31 rolls forwards, if pressure is exerted downwards, the annular ratchet wheel 41 and the pawl assembly 42 are in the free-sliding and maintain-rolling status. On the other hand, when the front wheel 31 rolls backwards, if pressure is exerted downwards, the annular ratchet wheel 41 and the pawl assembly 42 are in the occlusion and cease-rolling status. It is to say, when the front wheel 31 is pressed downward, the annular ratchet wheel 41 and the pawl assembly 42 are engaged to stop the front wheel 31 from rolling in one direction, but the front wheel 31 can be rolled in another direction.

Figure 6:
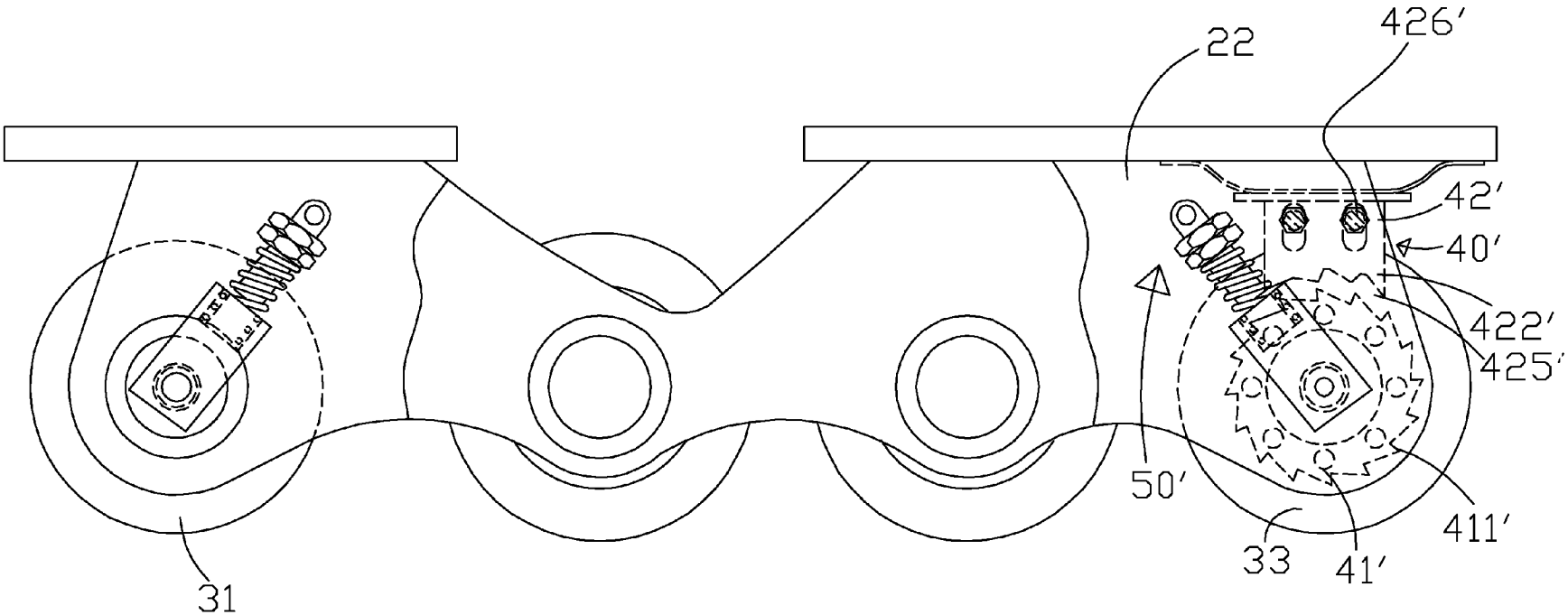
FIG. 6 shows a schematic diagram according to a second preferred embodiment of the present invention.

FIG. 6 shows a schematic diagram of a structure of inline skates according to a second preferred embodiment of the present invention, and is used for describing that an one-way roll stop device 40' and a cushion device 50' are disposed on the rear wheel 33. The difference between the present embodiment and the previous embodiment is that the one-way roll stop device 40' is disposed as stopping rolling while rolling forwards. That is, the directions of the first ratchet teeth 411' of an annular ratchet wheel 41' and the second ratchet teeth 425' of a pawl assembly 42' are opposite to the directions of those disposed on the front wheel 31. Thereby, when a player needs braking or is about to fall down faceup carelessly, by pressing the rear wheel 33 downwards by his weight to some extent, the annular ratchet wheel 41' on the side of the rear wheel 33 contacts the pawl assembly 42', and thus ceasing the rear wheel 33 from rolling forwards in one direction. Accordingly, a braking force is attained for braking and a forward supporting reaction force is provided for avoiding falling down backwards.

In addition, the baking effect according to the present embodiment is far superior to the braking effect of the rear brake pad in a recreational inline skate according to the prior art without the drawbacks and danger brought about by the latter. Moreover, as same as above description of the first preferred embodiment, the annular ratchet wheel 41' and the pawl assembly 42' are spaced from one another and the annular ratchet wheel 41' does not contact with the pawl assembly 42' when the player does not press the rear wheel 33. In this scenario, the roll of the rear wheel 33 is not affected and the rear wheel 33 can roll forwards or backwards. Otherwise, a long pivotal bore is disposed on the rear end of the side plate 22 according to this embodiment for disposing the cushion device 50'. The side plate 22 has an orientation hole according to this embodiment. The pawl assembly 42' is orientated by passing the orientation member 426' through the orientation hole. At least one bearing is disposed on the rear wheel 33 according to this embodiment.

Figure 7:
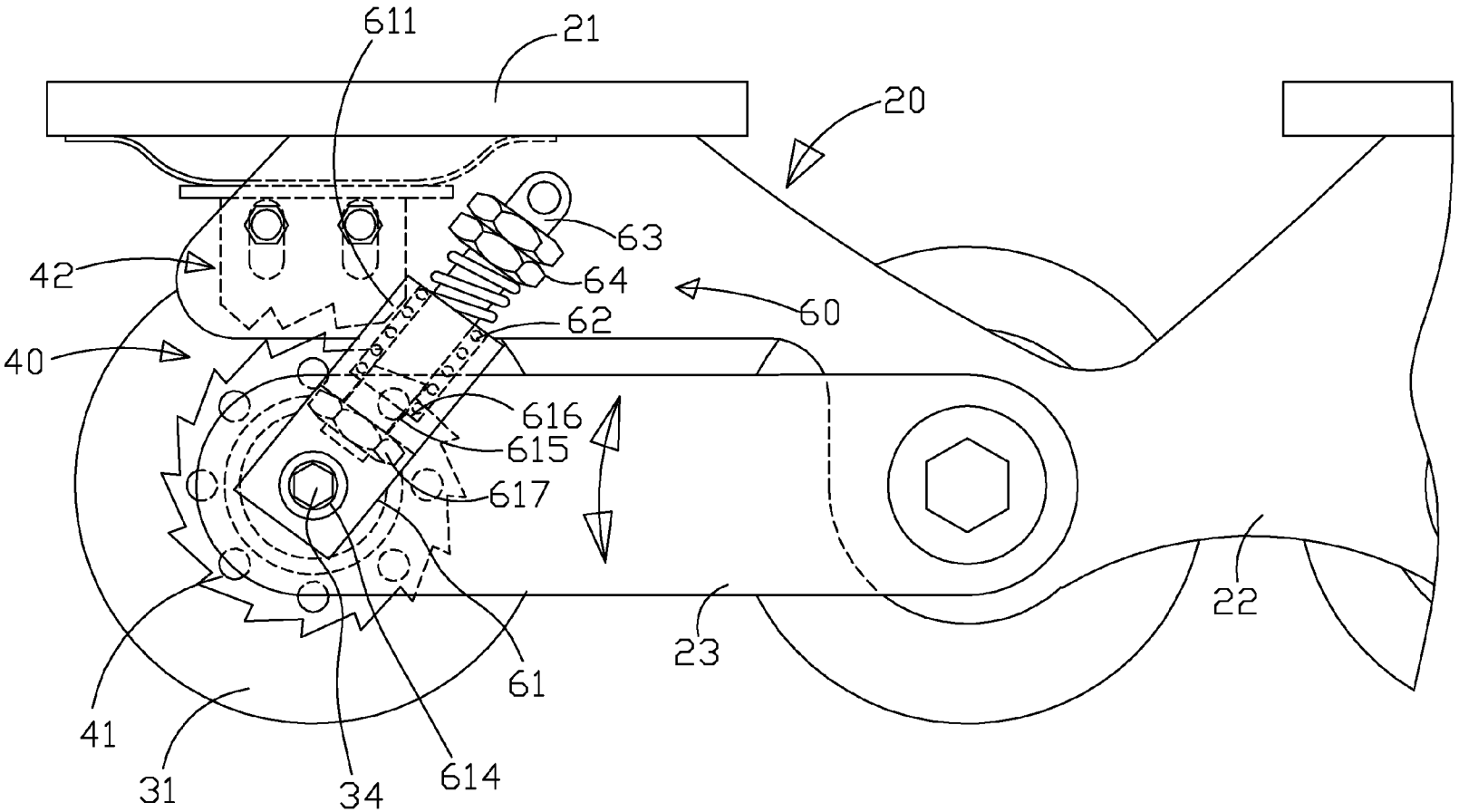
FIG. 7 shows a schematic diagram according to a third preferred embodiment of the present invention.

FIG. 7 shows a schematic diagram of a structure of inline skates according to a third preferred embodiment of the present invention. The third preferred embodiment is provided on the basis of the first preferred embodiment described above. The annular ratchet wheel 41 and the pawl assembly 42 are disposed likewise. The difference is the cushion device 60 of this embodiment. The side plates 22 of the base 20 are further divided into connection side plates 23 on both sides. The back end of the connection side plate 23 connects with the side plate 22, and the front end thereof is used for pivoting the front wheel 31. In addition, the cushion device 60 includes a sleeve assembly 61, a spring 62, an adjustment shaft 63 and at least one nut 64. The sleeve assembly 61 includes a sleeve 611, and a pivotal hole 614 is disposed under the sleeve 611. The pivotal hole 614 is provided for fixing the sleeve assembly 61 on the side of the front wheel 31 and the side of the connection side plate 23 by means of the screw bolt assembly 34.

A penetrating trough 615 is disposed in the sleeve 611 of the cushion device 60 and is used for accommodating the spring 62. Inside the penetrating trough 615, a ring-stop surface 616, which is used for stopping the spring 62. The spring 62 is putted around the adjustment shaft 63, and the top end of the adjustment shaft 63 is fixed on the side plate 22 of the base 20. Otherwise, the top end of the adjustment shaft 63 is fixed on the connection plate 21 of the base 20. Threads are adapted on the adjustment shaft 63 with the nut 64 thereupon for confining the spring 62 between the trough 615 and the nut 64. When the adjustment shaft 53 is passed through the penetrating trough 615, a nut 617 or a C type ring is used for securing under the lower end of the adjustment shaft 53. Thereby, the position of the front wheel 31 can be orientated by means of the connection side plate 23, the sleeve 611, and the adjustment shaft 53. Besides, the compression force of the spring 62 can be adjusted by adjusting the nuts 54. Furthermore, the connection side plate 23 also can be connected with the rear wheel 33, and the cushion device 60 is disposed on the rear wheel 33.

Figure 8:
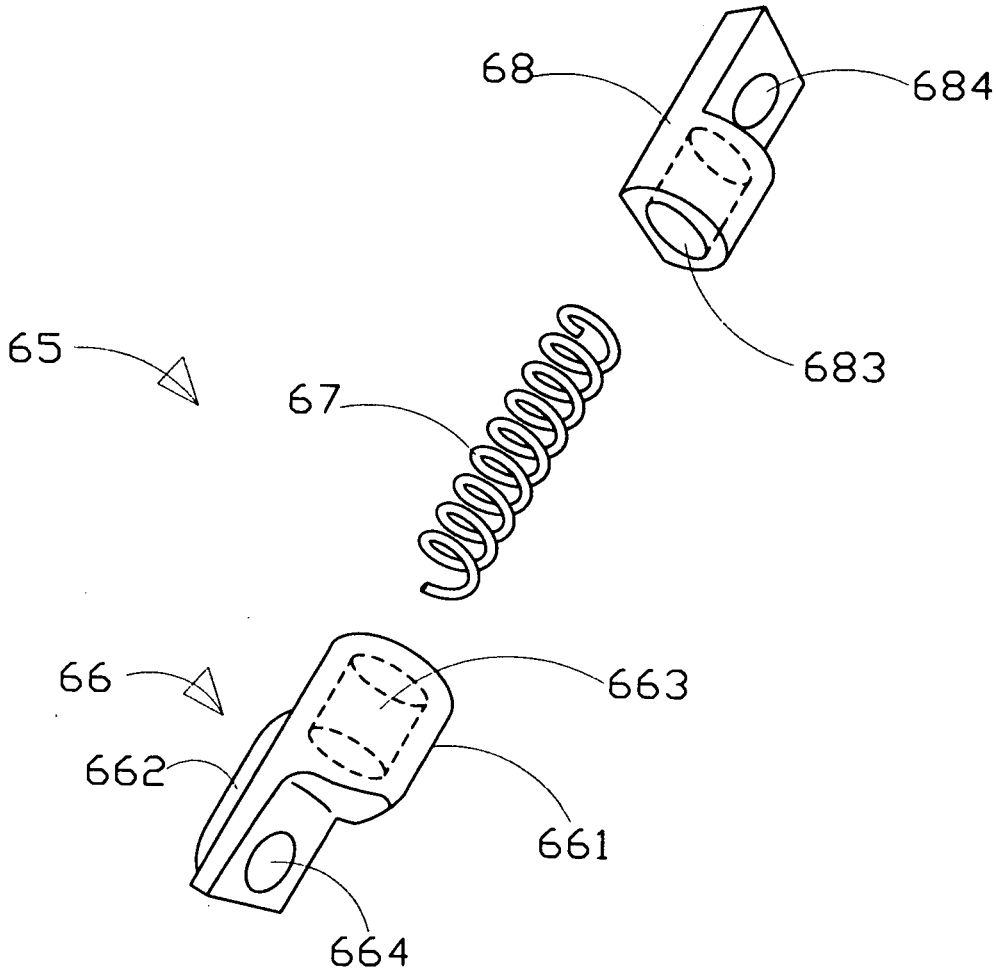
FIG. 8 shows a schematic diagram of another preferred embodiment of the cushion device according to the present invention.

FIG. 8 shows a schematic diagram of another preferred embodiment of the cushion device according to the present invention. The cushion device 65 includes a sliding block and sleeve assembly 66, a spring 67, and an upper sleeve 68. The sliding block and sleeve assembly 66 includes a sleeve 661, a sliding block 662 and a pivotal hole 664. The sliding block 662 is disposed on the rear side of the sleeve 661, and is corresponding to the long pivotal bore 221 of the base 20 with a shorter length (as shown in FIG. 2). The pivotal hole 664 is disposed at the lower end of the sleeve 661. The screw blot assembly 34 passes through the pivotal hole 664, the long pivotal bore 221 and the front wheel 31, and the sliding block 662 is inset the long pivotal bore 221 to fixing the sliding block and sleeve assembly 66 and the front wheel 31 on the base 20.

A trough 663 is disposed at the top end of the sleeve 661 and is used for accommodating the spring 67. The upper sleeve 68 is disposed on the side plate 22 or the connection plate 21 of the base 20 by means of a fixed member (not shown in the Figures). The upper sleeve 68 includes an upper trough 683, which is corresponding to the sleeve 661 of the sliding block and sleeve assembly 66. The spring 67 is confined between the trough 663 and the upper trough 683. Otherwise, by adding spacers to the trough 663 and/or the upper trough 683, the compression force of the spring 67 can be adjusted accordingly. Hence, requirements by players with different weights or by various cushioning conditions can be met by adjustments at any time. The cushion device 65 according to this embodiment also can be disposed on the rear wheel 33, and the rear end of the base 20 also includes a long pivotal bore for insetting the sliding block 662 of the sliding block and sleeve assembly 66.

Figure 9:
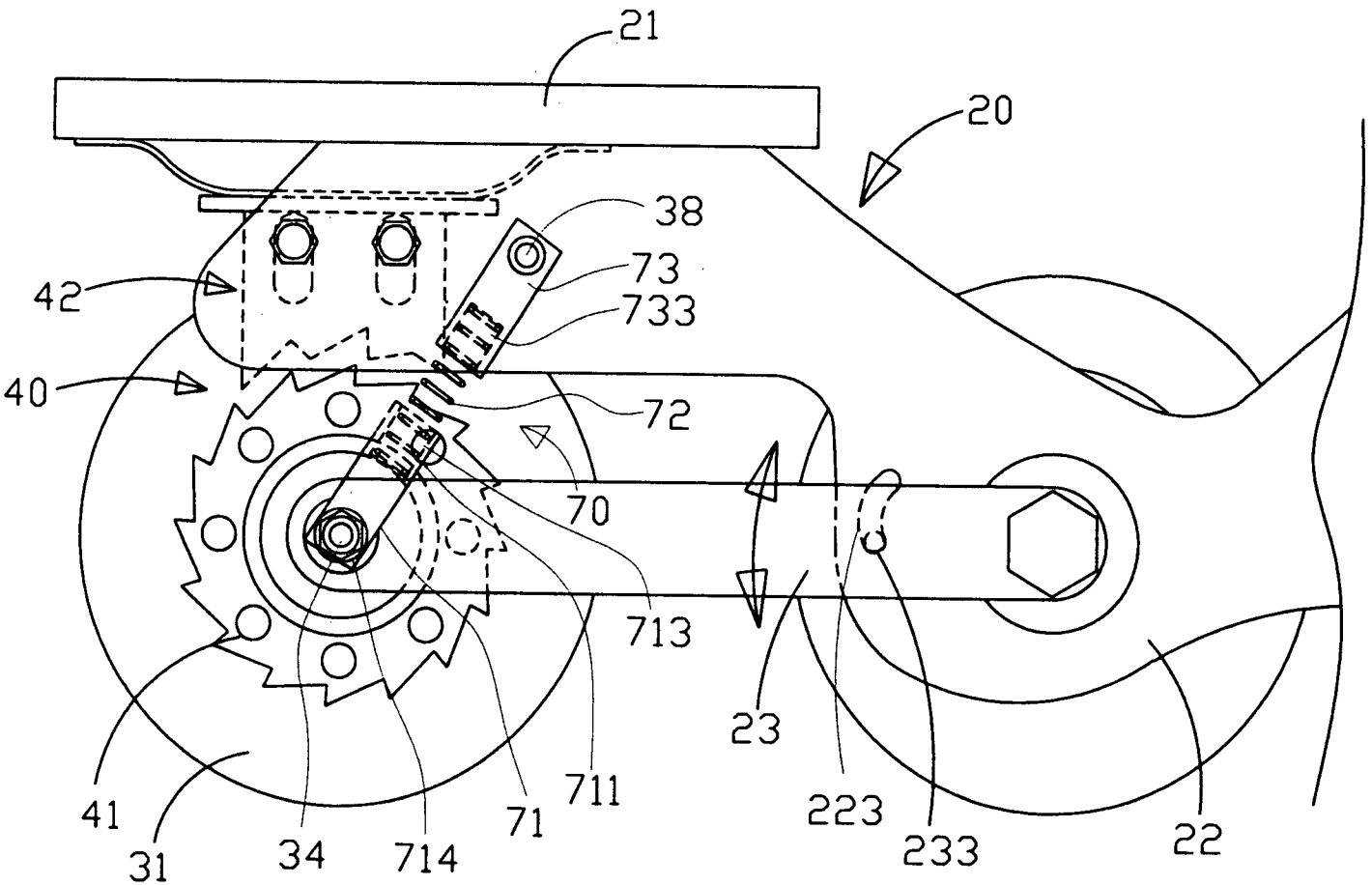
FIG. 9 shows a schematic diagram according to a fourth preferred embodiment of the present invention.

FIG. 9 shows a schematic diagram of a structure of inline skates according to a fourth preferred embodiment of the present invention. The cushion device 70 of this preferred embodiment is different from the cushion device 65 of the FIG. 8. The cushion device 70 includes a sleeve assembly 71, a spring 72 and an upper sleeve 73. The sleeve assembly 71 includes a sleeve 711 and a pivotal hole 714. The pivotal hole 714 is disposed at the lower end of the sleeve 711. The sleeve assembly 71 is fixed on the side of the front wheel 31 and the side of the connection side plate 23 by passing the screw bolt assembly through the pivotal hole 714. A trough 713 is disposed on the sleeve 711 and is used for accommodating the spring 72. The upper sleeve 73 is disposed on the side plate 22 or the connection plate 21 of the base 20 by means of a fixed member 38. The upper sleeve 73 includes an upper trough 733. The spring 72 is confined between the trough 713 and the upper trough 733. Otherwise, the side plate 22 further includes an arc trench 223, and the connection side plate 23 further includes a pillar 233. The pillar 233 is inset the arc trench 223, and the pillar 233 is movable in the arc inset 223.

Figure 10:
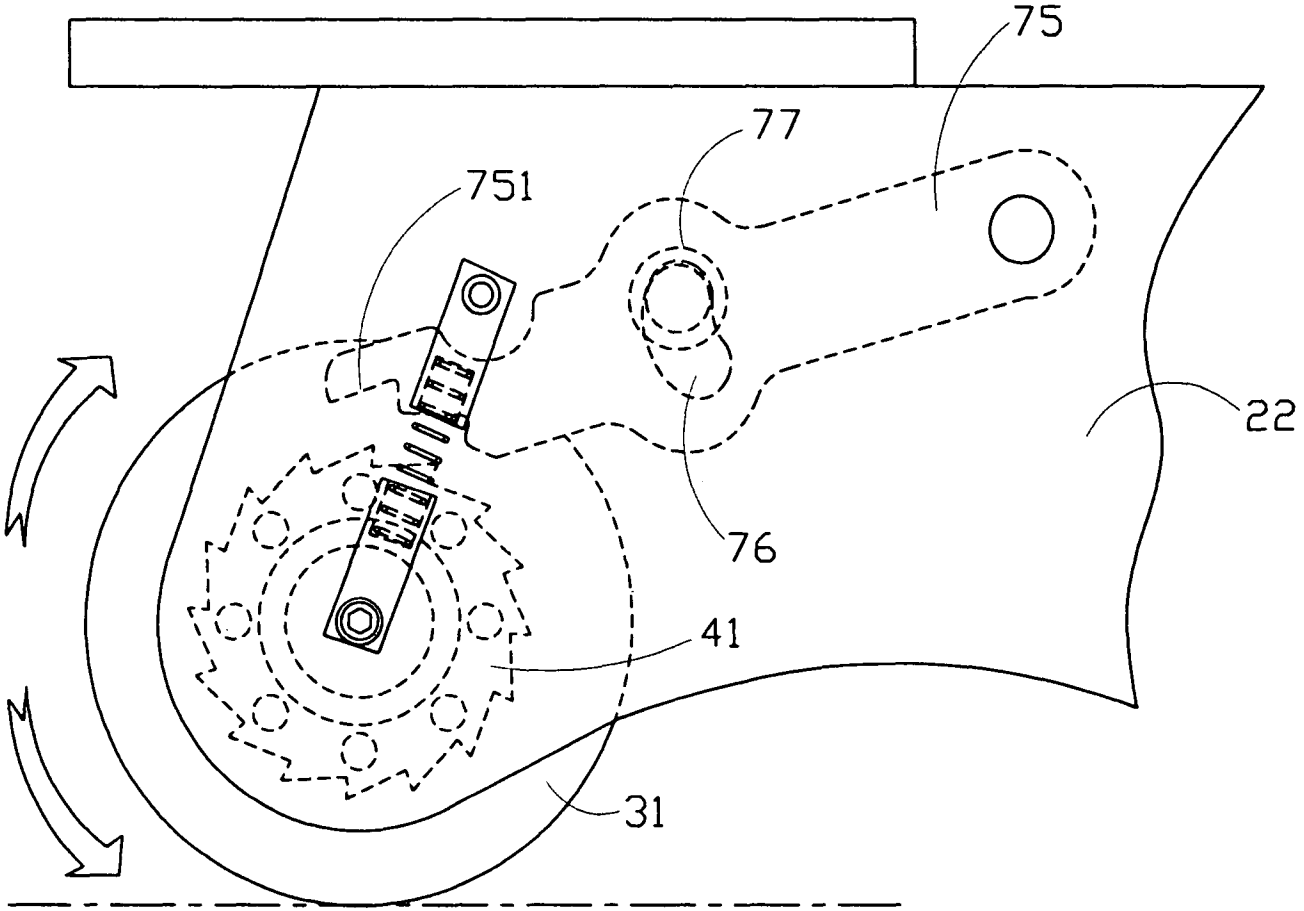
FIG. 10 shows a schematic diagram according to a fifth preferred embodiment of the present invention.

FIG. 10 shows a schematic diagram of a structure of inline skates according to a fifth preferred embodiment of the present invention. The pawl assembly 75 of this preferred embodiment is different from the pawl assembly 42 of the previous embodiment. The pawl assembly 75 is disposed between the inside of the side plate 22 of the base 20 and the front wheel 31. One end of the pawl assembly 75 is disposed on the side plate 22 of the base 20, and another end of the pawl assembly 75 includes at least one second ratchet tooth 751. A long bore 76 is disposed on the pawl assembly 75. An orientation member 77 is disposed on the base 20 by passing through the long bore 76. The pawl assembly 75 is orientated by the orientation member 77, and therefore the pawl assembly 75 and the annular ratchet wheel 41 are spaced from one another. The orientation member 77 is movable in the long bore 76. The pawl assembly 75 and the annular ratchet wheel 41 are not contacted each other when the position of the base 20 corresponding to the front wheel 31 is not pressed. Thereby, the front wheel 31 can roll forward or backward.

Figure 11:
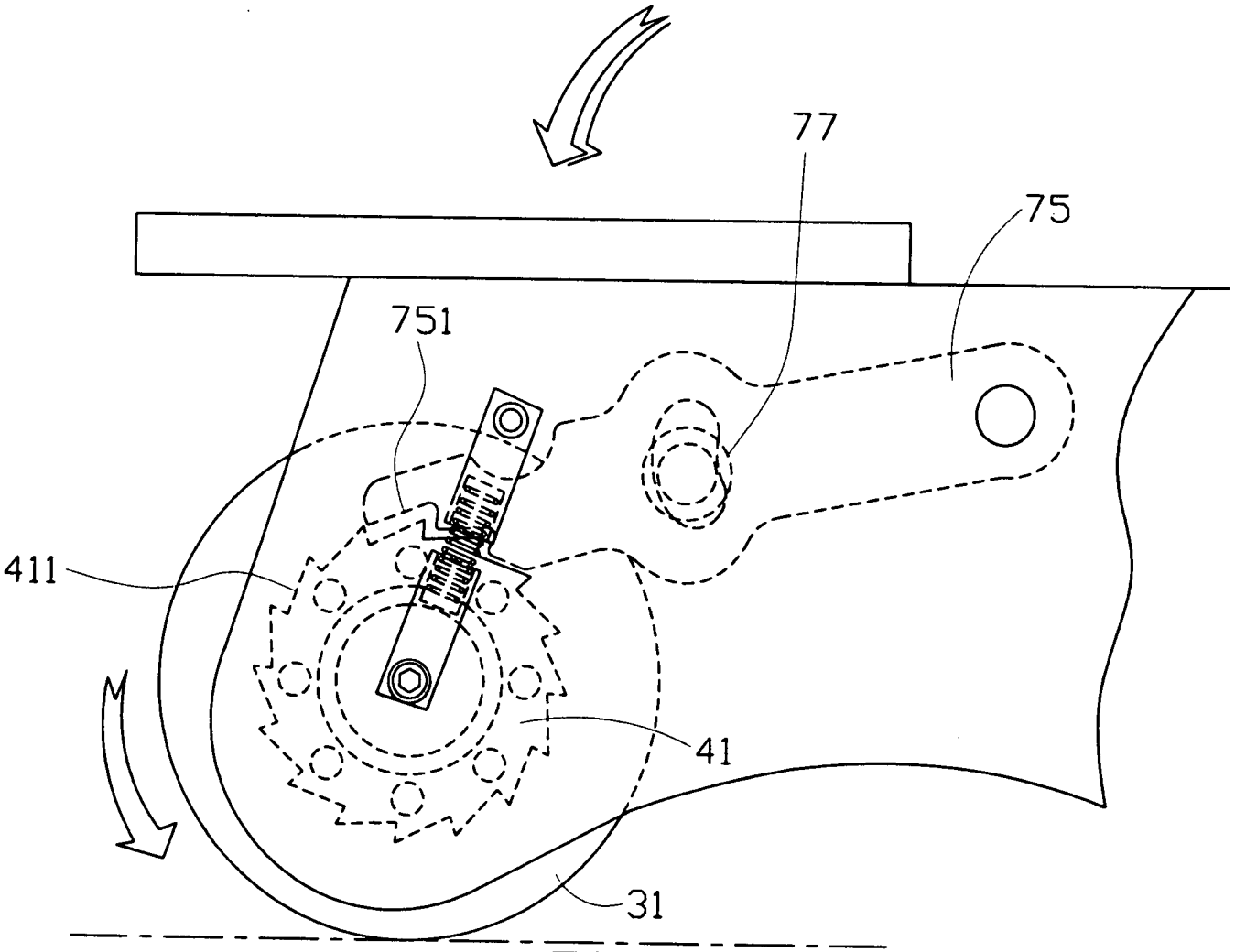
FIG. 11 shows a schematic diagram of stopping a front wheel according to a fifth preferred embodiment of the present invention.

As shown in the FIG. 11, when the position of the base 20 corresponding to the front wheel 31 is pressed, the front wheel 31 will move up to make the pawl assembly 42 engage the annular ratchet wheel 41 thereby stopping, the front wheel 31 from rolling in one direction, and rolling in another direction. In this embodiment, the front wheel 31 can rolls forwards, nor rolls backwards. The pawl assembly 75 and the annular ratchet wheel 41 also can be applied to the rear wheel 33 according to this embodiment. When the position of the base 20 corresponding to the rear wheel 33 is pressed, the pawl assembly 75 and the annular ratchet wheel 41 are engaged thereby stopping the rear wheel 33 from roll in one direction, and rolling in another direction. The directions of the annular ratchet wheel 41 and of the pawl assembly 75 disposed on the rear wheel 33 are opposite to the directions of those disposed on the front wheel 31. Thereby, the rear wheel 33 could roll forwards or backwards when player does not press the rear wheel 33, and when the player press the rear wheel 33, the annular ratchet wheel 41 and the pawl assembly 75 are engaged, so as to stop the rear wheel 33 from rolling forwards, but rolling backwards.

According to a preferably embodiment of the present invention, the inner diameter of the annular ratchet wheel 41 is 16-30 mm, and the outer diameter of the annular ratchet wheel 41 is 30-46 mm. The annular ratchet wheel 41 has 12-32 first ratchet teeth 411, and the pawl assembly 75 has 1-6 second ratchet teeth 751. According to a preferably embodiment, the engagement perimeter of the first ratchet teeth 411 of the annular ratchet wheel 41 and the second ratchet teeth 751 of the pawl assembly 75 is not over than three sixteenth of the peripheral of the annular ratchet wheel 41.

Figure 12:
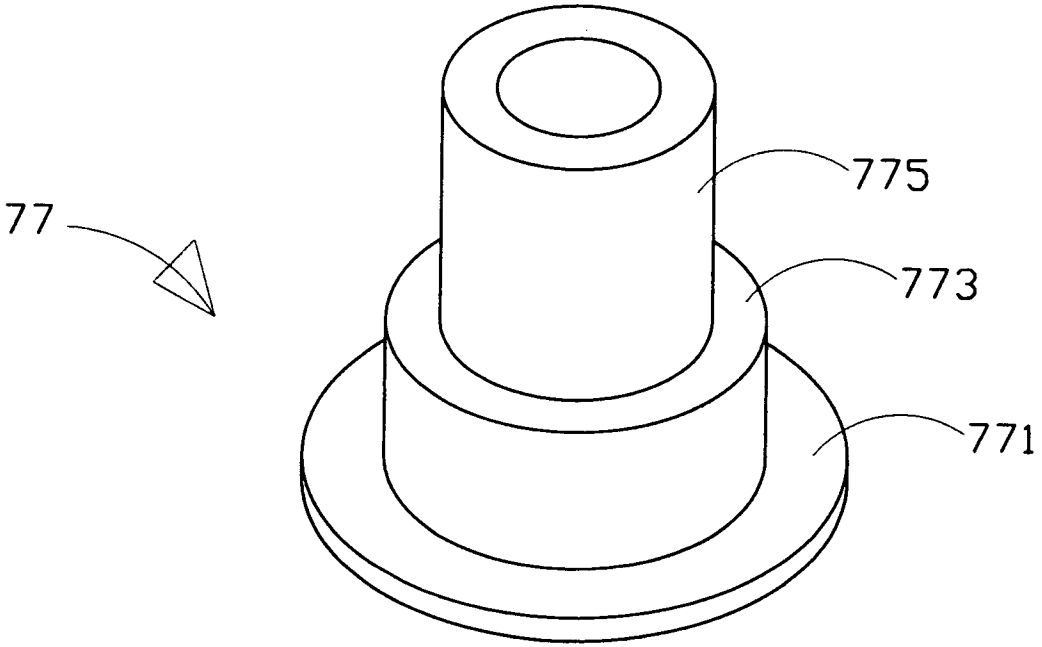
FIG. 12 shows a schematic diagram of the orientation member according to the present invention.
Figure 13:
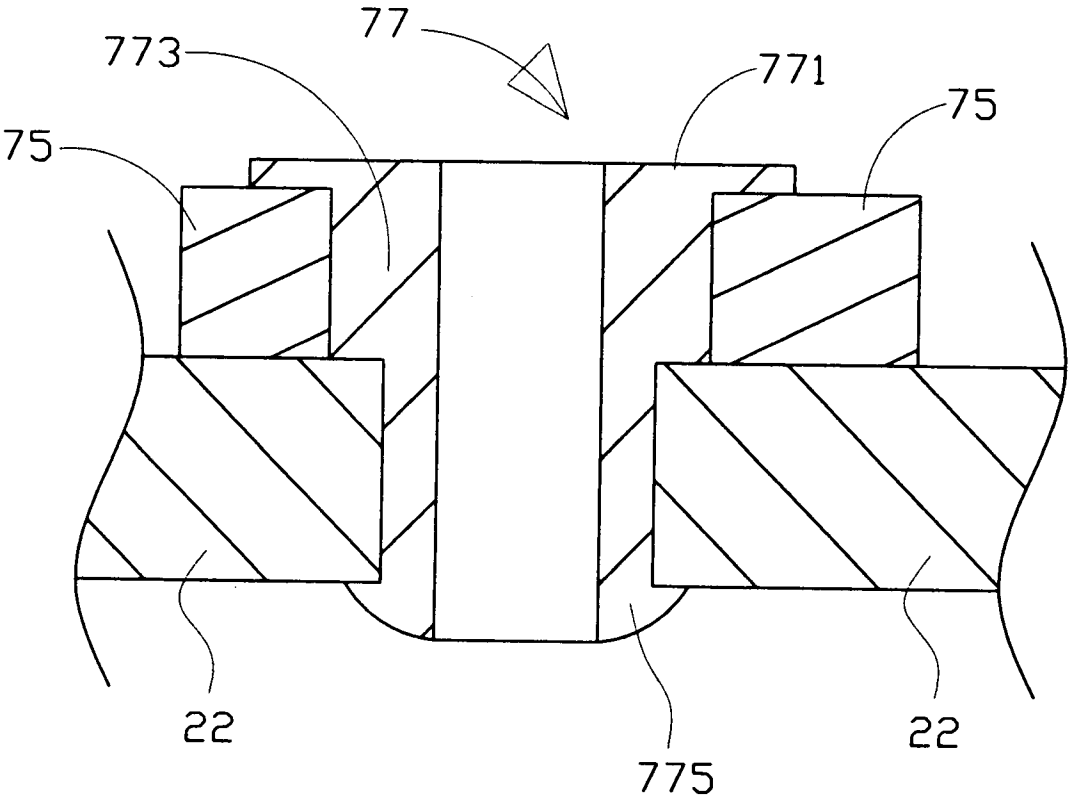
FIG. 13 shows a schematic diagram of the orientation member disposed on the pawl assembly and the side plate according to the present invention.

FIG. 12 shows a schematic diagram of the orientation member 77 of the FIGS. 10 and 11. The orientation member 77 includes a flange 771, a orientation shaft 773 and a fixing shaft 775. The flange 771 is disposed on the upper end of the orientation shaft 773, and the fixing shaft 775 extends from the lower end of the orientation shaft 773. The diameter of the flange 771 is greater than the diameter of the orientation shaft 773, and the diameter of the orientation shaft 773 is greater than the diameter of the fixing shaft 775. As shown in FIG. 13, when the orientation member 77 is disposed on the side plate 22 of the base 20 by passing through the long hole 76 of the pawl assembly 75, the fixing shaft 775 is fixedly coupled to the side plate 22 of the base 20, and the flange 771 and the side plate 22 of the base 20 would stop the pawl assembly 75. Thereby, the pawl assembly 75 would be orientated on the orientation shaft 773 to be opposite to the annular ratchet wheel 41 accurately.

Otherwise, the pawl assembly 75 would not be shake or wobble to contact the front wheel 31 or the rear wheel 33 for preventing the rolling of the front wheel 31 or the rear wheel 33 from the influence of the pawl assembly 75. Hence, when the base 20 is pressed, it would be ensure that the annular ratchet wheel 41 and the pawl assembly 75 are engaged. the orientation member 77 is a rivet according to a preferably embodiment.

Figure 14:
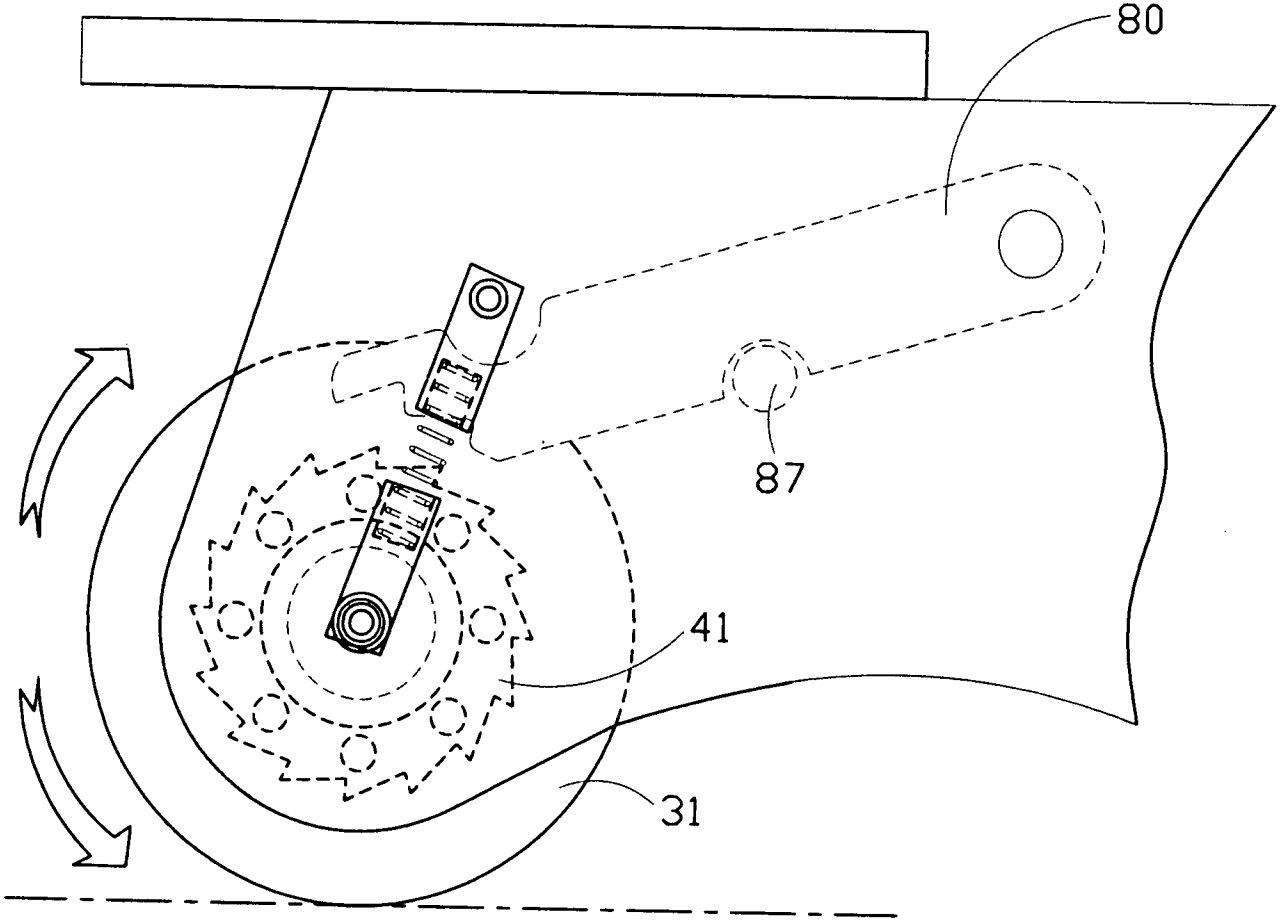
FIG. 14 shows a schematic diagram according to a sixth preferred embodiment of the present invention.

FIG. 14 shows a schematic diagram of a structure of inline skates according to a sixth preferred embodiment of the present invention. The pawl assembly 80 of this preferred embodiment does not include long hole 76 of the FIG. 10. The orientation member 87 is used for stopping the pawl assembly 80, and therefore the pawl assembly 80 and the annular ratchet wheel 41 are spaced from one another. Thereby, when the position of the base 20 corresponding to the front wheel 31 is not pressed, the pawl assembly 80 and the annular ratchet wheel 41 are not contacted with each other, therefore the front wheel 31 can roll forwards or backwards. When the position of the base 20 corresponding to the front wheel 31 is pressed, the front wheel 31 is moved up to make the pawl assembly 80 engage the annular ratchet wheel 41, thereby the front wheel 31 is stopped from rolling in one direction, and rolling in another direction.

According to above embodiment and description, the pawl assembly and the annular ratchet wheel are spaced from one another. Therefore, the front wheel or the rear wheel can roll forwards or backwards. However, when the position of the base corresponding to the front wheel or the rear wheel is pressed, the front wheel or the rear wheel will be moved up so as to make the pawl assembly engage the annular ratchet wheel. Thereby, the front wheel or the rear wheel is stopped from rolling in one direction, and being able to roll in another direction. The structure of the pawl assembly and he annular ratchet wheel of the present invention is different from the conventional structure of the pawl and the ratchet wheel, which is used for rolling in one direction only.

Figure 18A:
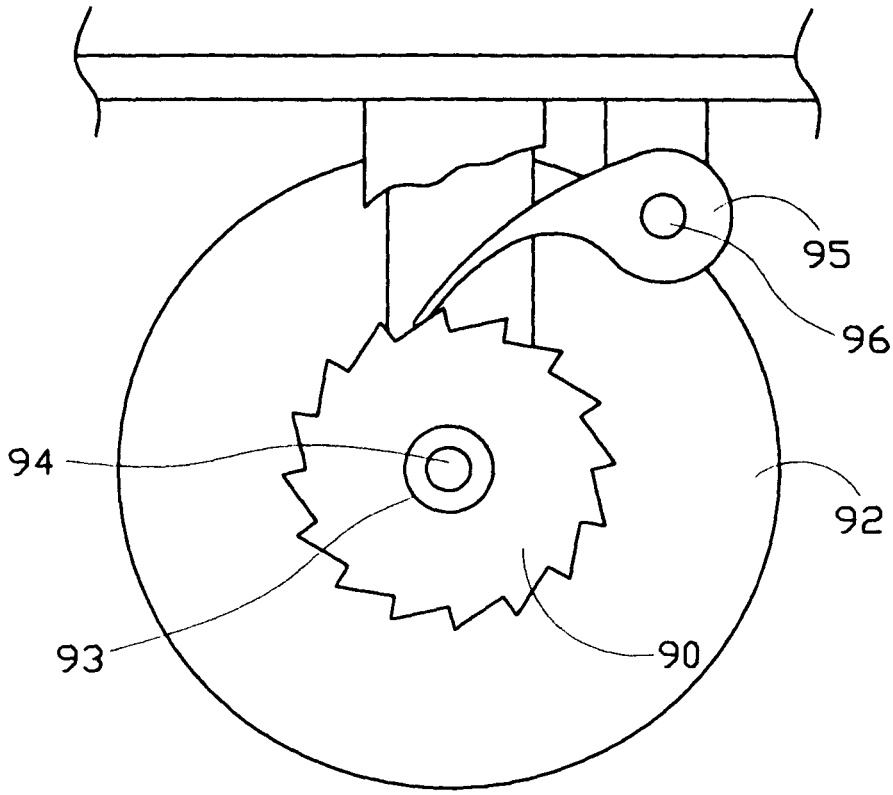
Fig. 18A(Prior Art)
FIG. 18A shows a schematic diagram of conventional pawl stopping the ratchet wheel according to prior art.
Figure 18B:
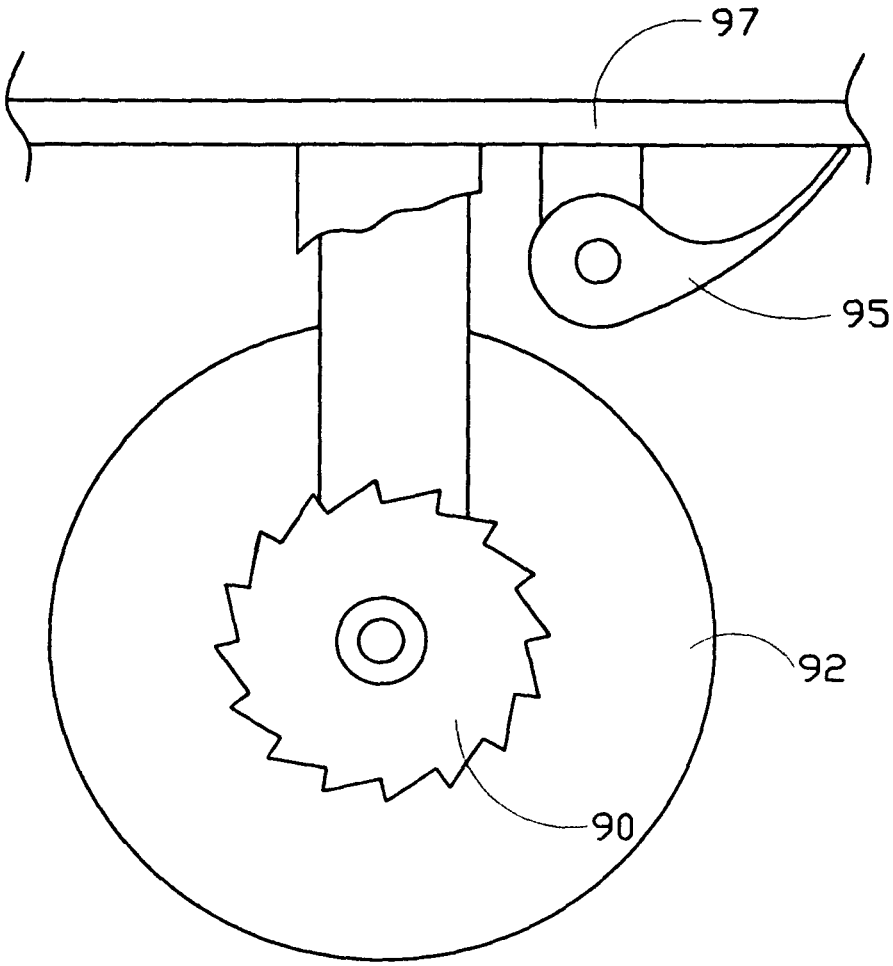
Fig. 18B(Prior Art)
FIG. 18B shows a schematic diagram of conventional pawl separated from the ratchet wheel according to prior art.

As shown in FIG. 18A, in conventional concept, a ratchet wheel 90 and a pawl 95 are kept in contact with each other generally. The ratchet wheel 90 has an axle hole 93 for pivoting a shaft 94 to be disposed on a wheel 92. One end of the pawl 95 is disposed on a shaft 96, and a spring (not shown in Figures) is disposed on the shaft 96, and the pawl 95 is always contacted with the ratchet wheel 90 since the elastic force of the spring affects to the pawl 95. Thereby, the ratchet wheel 90 and the pawl 95 would be contacted with each other to limit the wheel 92 to rolling in one direction, nor rolling forwards or backwards. If the conventional ratchet wheel 90 is spaced from the pawl 95, the pawl 95 is rotated by the elastic force of the spring. Therefore, the pawl 95 contacts against the base plate 96, as shown in FIG. 18B. Therefore, the pawl 95 can be not used for engaging the ratchet wheel 90 again.

Although the pawl assembly is separated from the annular ratchet wheel according to the present invention, but these would not occur above problem of the ratchet wheel 90 and the pawl 95. The present invention is to use the orientation member orientating the pawl assembly for making the pawl assembly and the annular ratchet wheel be spaced from one another and disposed on the most appropriate position to be in engagement. When the position of the base corresponding to the front wheel or the rear wheel is not pressed, the front wheel or the rear wheel is moved up to make the pawl assembly engage the annular ratchet wheel. Thereby, the front wheel or the rear wheel is stopped from rolling in one direction, but the front wheel or the rear wheel can be rolled in another direction.

Accordingly, the design concept of the pawl assembly and the annular ratchet wheel according to present invention is different from the design concept of the conventional pawl and the conventional ratchet wheel. Otherwise, the conventional ratchet wheel has a axis hole for pivoting on the shaft, so that the wheel with the conventional ratchet wheel cannot be convenient for changing the bearing of the wheel. However, the present invention has a hole whose diameter is greater than the diameter of the bearing, nor axis hole. Thereby, it is convenient to change the bearing of the wheel and is effect to reduce the weight of the annular ratchet wheel.

Figure 15:
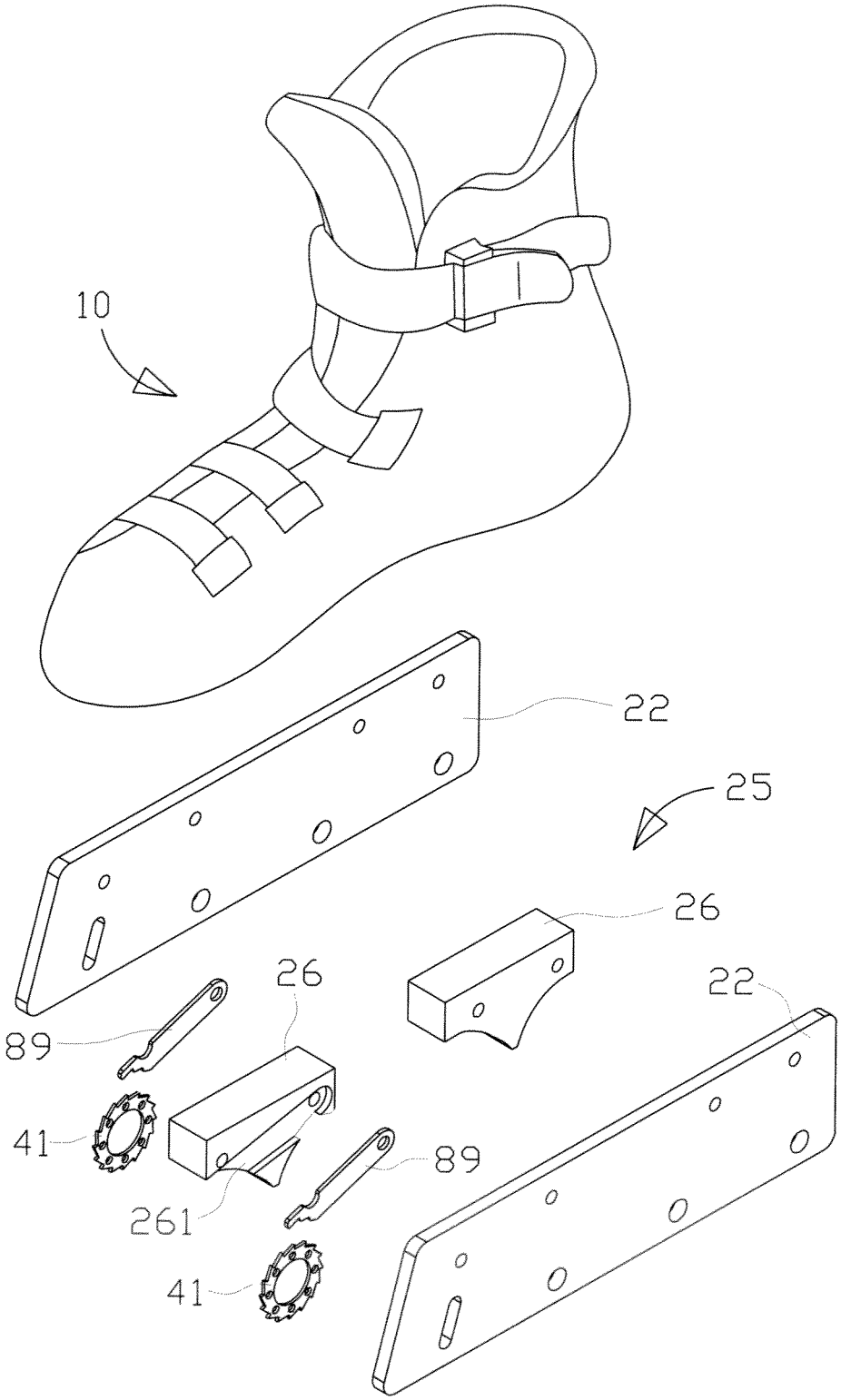
FIG. 15 shows a schematic diagram according to a seventh preferred embodiment of the present invention.

FIG. 15 shows a schematic diagram of a structure of inline skates according to a seventh preferred embodiment of the present invention. A base 25 of this preferred embodiment is different from the base 20 of FIG. 2. The base 25 includes at least one connection block 26 and two side plates 22, preferably the base 20 has two connection blocks 26 according to this preferred embodiment. The connection block 26 serves as a connection member to connect the two side plates 22. A plurality of fixing member (no shown in Figures) are passed through the two side plates 22 and the two connection blocks 26 to dispose the two side plates 22 on the both sides of the two connection blocks 26. A orientation trench 261 is disposed on at least one side of the connection block 26 corresponding to the front wheel 31, preferably two orientation trenches 261 are disposed on both sides of the connection block 26. The two orientation trenches 261 serve as two orientation members to orientate the two pawl assemblies 89 for making the two pawl assemblies 89 and the two annular ratchet wheels 41 are spaced from one another, and the two pawl assemblies 89 are corresponding to the two annular ratchet wheels 41, respectively.

Figure 16:
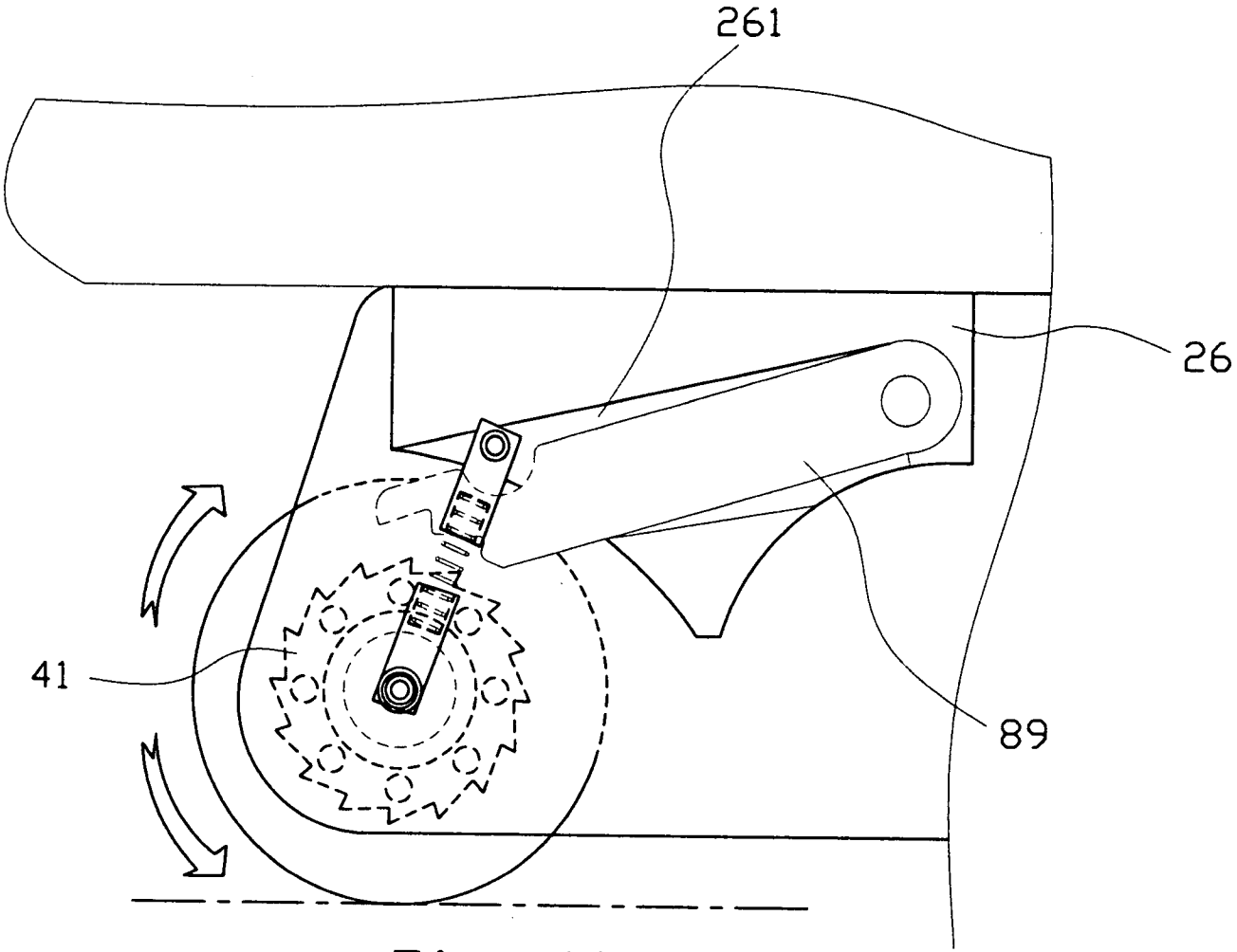
FIG. 16 shows a schematic diagram according to a eighth preferred embodiment of the present invention.

One end of the pawl assembly 89 is disposed on the orientation trench 261 by the fixing member (not shown in Figures). The pawl assembly 89 is inset the orientation trench 261, and the orientation trench 261 is larger than the pawl assembly 89. The pawl assembly 89 is orientated on the orientation trench 261 since the side wall of the orientation trench 261 and the side plate 22 stop the pawl assembly 89. As shown in FIG. 16, the pawl assembly 89 is opposite to the annular ratchet wheel 41 accurately, and the pawl assembly 89 would be wobbled to contact with the front wheel 31 for preventing the rolling of the front wheel 31 from the influence. Hence, when the base 25 is pressed, it is ensure that the pawl assembly 89 engages the annular ratchet wheel 41.

Figure 17:
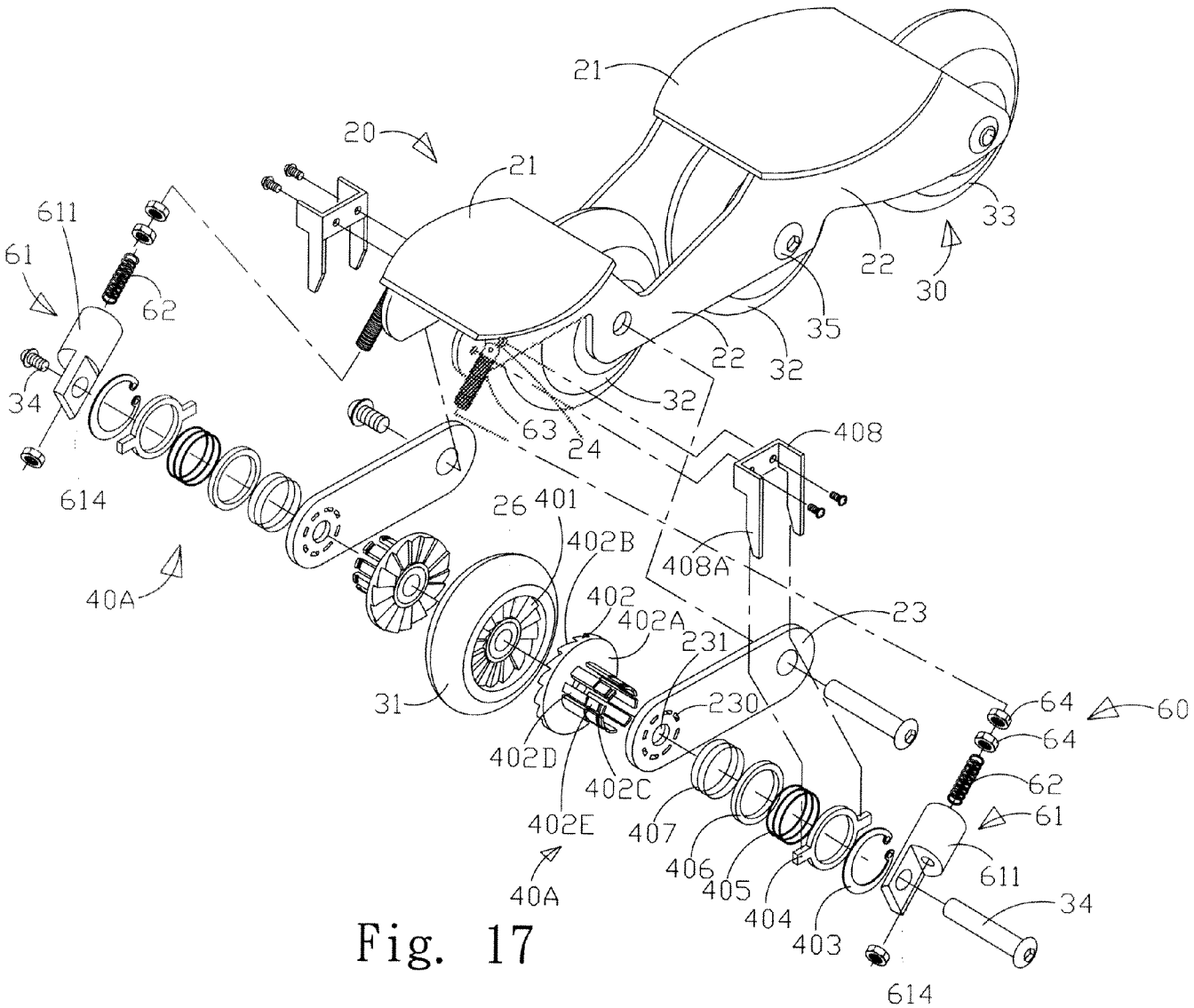
FIG. 17 shows a schematic diagram according to a ninth preferred embodiment of the present invention.

FIG. 17 shows a schematic diagram of an improved structure of inline skates according to a ninth preferred embodiment of the present invention. The ninth preferred embodiment is provided on the basis of the above preferred embodiment described above. The ninth preferred embodiment adopts different device for embodying at least one one-way roll stop device 40A. The adjustment shaft 63 of the cushion device 60 is disposed on a pivotal hole 24 in front side of the side plate 22. The cushion device 60 is connected with the front wheel 31 and the connection side plate 23 by means of a screw bolt assembly 34. However, a different device is adopted for embodying said at least one one-way roll stop device 40A. First, a plurality of surrounding arc-shaped holes 230 is disposed on the connection side plate 23, and a pivotal hole 231 is disposed on the center of said plurality of surrounding arc-shaped holes 230.

Besides, the one-way roll stop device 40A includes a side ratchet wheel 401 and a side pawl 402, and the side ratchet wheel 401 and the side pawl 402 are defined as a roll member and a brake member respectively. The side ratchet wheel 401 is disposed inside the front wheel 31. At least one bearing 26 is disposed on the front wheel 31, and the side ratchet wheel 401 includes a hole whose diameter is greater than the diameter of the bearing 26. The side pawl 402 has an annular body 402A, one side of the annular body 402A has at least one ratchet tooth 402B. The ratchet tooth 402B correspond to the side ratchet wheel 401, and can engage with each other or slide freely, and the annular body 402A has a plurality of the ratchet teeth 402B according to the embodiment. When the front wheel 31 rolls forwards, the ratchet teeth 402B slides freely with the side ratchet wheel 401. On the contrary, when the front wheel 31 rolls backwards, the ratchet teeth 402B engages with the side ratchet wheel 401. On the other side of the annular body 402A, a plurality of first stick-like parts 402D and a plurality of second stick-like parts 402E are both distributed annularly. The first stick-like parts 402D are thicker than the second stick-like parts 402E, and a trench 402C is disposed on the end of each second stick-like part 402E. The plurality of surrounding arc-shaped holes 230 is larger than the plurality of first stick-like parts 402D and second stick-like parts disposed on one side of the annular body 402A of the side pawl 402. In addition, each second stick-like part 402E of the side pawl 402 is passed through the plurality of surrounding arc-shaped holes 230 disposed on the connection side plate 23, as same as above description of the first preferred embodiment, the side ratchet wheel 401 and the side pawl 402 are spaced from one another.

A second compression spring 407, a spacer 406, a first compression spring 405, a special-shaped spacer 404, and a hook ring 403 are slip on sequentially thereon. The hook ring 403 clips on a trench 402C. The inner radius of the spacer 406 is smaller than the outer radius of the circle surrounded by the first stick-like parts 402D, and the elastic force of the second compression spring 407 is smaller than that of the first compression spring 405. Thereby, a driving apparatus is defined to include a driver 408, the second compression spring 407, the spacer 406, the first compression spring 405, the special-shaped spacer 404, and the hook ring 403. Owing to the functions of the first compression spring 405 and the second compression spring 407, the annular body 402A of the side pawl 402 maintains tight contact with the connection side plate 23 under normal conditions. Therefore, the side ratchet wheel 401 and the side pawl 402 are spaced from one another.

In addition, the driver 408 is disposed on the side plate 22 and is disposed the upper side of the special-shaped spacer 404. When weight presses the connection plate 21, the cushion device 60 is compressed accordingly, which makes the driver 408 close and contact the special-shaped spacer 404. Because the contact surface between the driver 408 and the special-shaped spacer 404 is an inclined plane 408A, when the driver 408 is pressed down, it will produce a pressing force on the special-shaped spacer 404 towards the connection side plate 23. Nevertheless, because the inner radius of the spacer 406 is smaller than the outer radius of the circle surrounded by the first stick-like parts 402D, and the elastic force of the second compression spring 407 is smaller than that of the first compression spring 405, said pressing force towards the connection side plate 23 will not compress the first compression spring 405, but, instead, will force the spacer 406 to compress the second compression spring 407 and thereby make the side pawl 402 move towards the side ratchet wheel 401. At this moment, if the front wheel 31 rolls backwards, the side ratchet wheel 401 will engage the side pawl 402 and the rolling of the front wheel 31 is stopped in one direction. However, the front wheel 31 can roll in another direction. On the contrary, if the front wheel 31 rolls forwards at the moment, due to deployment of the first compression spring 405, the side ratchet wheel 401 and the side pawl 402 slide freely. In addition, the driver 408 does not contact the special-shaped spacer 404 and the side ratchet wheel 401 and the side pawl 402 are spaced from one another when the player does not press the front wheel 31. Therefore, the side ratchet wheel 401 does not contact the side pawl 402 and the roll of the front wheel 31 is not affected, and therefore the front wheel 31 can roll forwards or backwards. From the description above, it is known that the present has at least the following effects and features:

1. If the cushion device and the one-way roll stop device according to the present invention are disposed on the front wheel, when the front wheel is pressed to some extent while rolling backwards, the front wheel has the capability of stopping rolling backwards and in one direction. If the cushion device and the one-way roll stop device according to the present invention are disposed on the rear wheel, when the rear wheel is pressed to some extent while rolling forwards, the rear wheel has the capability of stopping rolling forwards and in on direction. 2. According to the present invention, if forward propelling is desired by pressing backwards, because the propelling leg is pressed downwards by weight and the front wheel is pushed backwards, which is in a back-rolling status, thereby, back-rolling is stopped in one direction. Consequently, a hold for propelling forward that is more powerful and more ergonomic is given. 3. The operation of the braking function on the front wheel according to the present invention is similar to the ratchet wheel in front of a general figure skate or to the brake pad in front of a conventional four-wheel skate, and is done by tipping toes while sliding backwards. At this moment, the front wheel is pressed while rolling backwards, thereby, a braking function that is more ergonomic and safe is given. The braking effect of the rear wheel is similar to the braking effect of the rear brake pad in a recreational inline skate. When the player slides forwards, if he puts forth his strength to raise his feet upwards with his weight pushed downwards the rear wheel, at which moment the rear wheel is pressed to some extent and rolling forward, a braking effect that stops rolling forwards is attained. The baking effect is far superior to the braking effect of the rear brake pad in a recreational inline skate according to the prior art without the drawbacks and danger brought about by the latter.

4. As provided in the front and the rear wheels according to the present invention, when the player steps forward, because of the cushion devices disposed thereon, tiptoes and ankles are cushioned and shock-absorbed. Thereby, ergonomic effect is attained.

5. When the players is about to fall down forwards carelessly, because the front wheel is pressed by weight while rolling backwards, a braking force is given for stopping rolling backwards and in one direction. Thereby, the player is supported upright automatically. When the players is about to fall down faceup carelessly, because the rear wheel is pressed by weight while rolling forwards, a braking force is given for stopping rolling forwards. Thereby, the player is supported by the reaction force upright automatically. Hence, the present invention can provide a function of automatically support upright before falling down faceup carelessly or falling down forwards carelessly.

Accordingly, the present invention conforms to the legal requirements owing to its novelty, non-obviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

I claim:

1. A structure of inline skates, comprising:

a base, comprising at least one connection member, an orientation member, and two side plates being disposed on both sides of the connection member, respectively with a plurality of pivotal holes thereon, a front end or a rear end of the least one side plate having a long pivotal bore;

a wheel set, comprising a front wheel and a rear wheel, the front wheel and the rear wheel being pivoted on the side plates, the front wheel and the rear wheel having at least one bearing respectively;

at least one one-way roll stop device, comprising an annular ratchet wheel and a pawl assembly, the annular ratchet wheel being fixedly coupled to the side of the front wheel or the rear wheel, the annular ratchet wheel having a hole to form an annular shape, the diameter of the hole being greater than the diameter of the bearing, the hole being opposite to the bearing, the pawl assembly being disposed on the base, the annular ratchet wheel being disposed opposite to the pawl assembly, the annular ratchet wheel and the pawl assembly being spaced from one another, wherein the orientation member is utilized to orientate the pawl assembly for making the pawl assembly space from the annular ratchet wheel when the position of the base corresponding to the front wheel or the rear wheel is not pressed; and at least one cushion device, including a sliding block and sleeve assembly and a spring, the sliding block and sleeve assembly including a sleeve with a trough adapted for accommodating the spring, and a pivotal hole being disposed at the lower end of the sleeve, a rear side of the sleeve including a sliding block with a shorter length and corresponding to the long pivotal bore, the sliding block being inserted to the long pivotal bore, one end of the cushion device being disposed on the base, and the other end of the cushion device being connected to the front wheel or the rear wheel by passing a screw bolt assembly through the pivotal hole of the sliding block and sleeve assembly, the long pivotal bore of the side plate and the front wheel or the rear wheel;

wherein when a position of the base corresponding to the front wheel or the rear wheel is not pressed, the annular ratchet wheel and the pawl assembly are not contacted to each other and the front wheel or the rear wheel can roll forwards or backwards, and when the position of the base corresponding to the front wheel or the rear wheel is pressed, the annular ratchet wheel contacts the pawl assembly thereby stopping the front wheel or the rear wheel from rolling in one direction, and the front wheel or the rear wheel being able to roll in another direction.

2. The structure of inline skates of claim 1, wherein the cushion device further includes an adjustment shaft, a top end of the adjustment shaft is fixed on the base, the adjustment shaft has a thread thereon with at least one nut, the spring is confined between the trough and the nut for adjusting a compression force of the spring.

3. The structure of inline skates of claim 1, wherein the cushion device further comprises an upper sleeve disposed on the base, the upper sleeve is corresponding to the sliding block and sleeve assembly, the upper sleeve has an upper trough for accommodating the spring.

4. The structure of inline skates of claim 1, wherein the pawl assembly has a long hole, the pawl assembly is orientated by passing the orientation member through the long hole for making the pawl assembly space from the annular ratchet wheel when the position of the base corresponding to the front wheel or the rear wheel is not pressed, the orientation member is movable in the long hole.

5. The structure of inline skates of claim 4, wherein the orientation member includes a flange, an orientation shaft and a fixing shaft, the flange is disposed on the upper end of the orientation shaft, the fixing shaft extends from the lower end of the orientation shaft, the diameter of the flange is greater than the diameter of the orientation shaft, the diameter of the orientation shaft is greater than the diameter of the fixing shaft, the orientation member is passed through the long hole of the pawl assembly for orientating the pawl assembly on the orientation shaft, the fixing shaft is fixedly coupled to the base, the flange and the base stop the pawl assembly.

6. The structure of inline skates of claim 1, wherein the orientation member is an orientation trench disposed on the connection member, the pawl assembly is disposed on the orientation trench, the orientation trench is larger than the pawl assembly.

7. The structure of inline skates of claim 1, wherein the wheel set further includes at least one intermediate wheel, and the intermediate wheel is pivoted on the side plate.

8. The structure of inline skates of claim 1, wherein the pawl assembly includes a plurality of ratchet teeth.

9. The structure of inline skates of claim 1, wherein the annular ratchet wheel includes a plurality of fixed holes and a plurality of fixing members for fixing the annular ratchet wheel on the side of the front wheel or the rear wheel by passing the fixing members through the fixed holes.

10. The structure of inline skates of claim 1, further comprising a boot disposed on the base.

* * * * *